US010733884B2

(12) United States Patent
Khandelwal et al.

(10) Patent No.: US 10,733,884 B2
(45) Date of Patent: Aug. 4, 2020

(54) SYSTEMS AND METHODS FOR INTELLIGENT VEHICLE SPEED DETERMINATION

(71) Applicant: Intel Corporation, Santa Clara, CA (US)

(72) Inventors: Rajkumar Khandelwal, Chandler, AZ (US); Matthew R. Torgerson, Chandler, AZ (US)

(73) Assignee: INTEL CORPORATION, Santa Clara, CA (US)

( * ) Notice: Subject to any disclaimer, the term of this patent is extended or adjusted under 35 U.S.C. 154(b) by 894 days.

(21) Appl. No.: 15/191,301

(22) Filed: Jun. 23, 2016

(65) Prior Publication Data

US 2017/0372605 A1 Dec. 28, 2017

(51) Int. Cl.

| | |
|---|---|
| ***G08G 1/09*** | (2006.01) |
| ***G08G 1/01*** | (2006.01) |
| ***G08G 1/16*** | (2006.01) |

(52) U.S. Cl.
CPC ..... *G08G 1/091* (2013.01); *G08G 1/0141* (2013.01); *G08G 1/166* (2013.01)

(58) Field of Classification Search
CPC ..... G08G 1/0145; G08G 1/095
See application file for complete search history.

(56) References Cited

U.S. PATENT DOCUMENTS

| | | | | |
|---|---|---|---|---|
| 8,723,680 | B1 * | 5/2014 | Baker | G08B 5/38 340/539.1 |
| 2008/0084283 | A1 | 4/2008 | Kalik | |
| 2015/0061896 | A1 | 3/2015 | Walther et al. | |
| 2015/0221222 | A1 | 8/2015 | Hamada et al. | |

(Continued)

FOREIGN PATENT DOCUMENTS

WO 2016-018636 A1 2/2016

OTHER PUBLICATIONS

International Search Report and Written Opinion issued in PCT/US2017/034260, dated Jul. 25, 2017, 13 pages.

(Continued)

*Primary Examiner* — Omeed Alizada
(74) *Attorney, Agent, or Firm* — Grossman, Tucker, Perreault & Pfleger, PLLC

(57) ABSTRACT

An intelligent infrastructure system includes traffic safety control circuitry coupled to a traffic control device. The traffic control device transitions from a current operating mode to a next operating mode on a defined schedule. The traffic safety control circuitry can receive information representative of the time remaining until the traffic control device transitions from the current operating mode to the next operating mode from the traffic control device. The traffic safety control circuitry broadcasts a message containing information representative of the time remaining to vehicular safety control circuitry in vehicles approaching the traffic control device. The vehicular safety control circuitry can provide the vehicle operator at least with information indicative of the time remaining in which the traffic control device will remain in the current operating mode. The vehicular safety control circuitry may provide the vehicle operator with additional recommendations such as accelerate, maintain speed, and decelerate/brake.

27 Claims, 7 Drawing Sheets

(56) References Cited

U.S. PATENT DOCUMENTS

| | | | | |
|---|---|---|---|---|
| 2015/0243164 | A1* | 8/2015 | Collum | G08G 1/07 340/916 |
| 2015/0310742 | A1 | 10/2015 | Albornoz | |
| 2016/0035223 | A1* | 2/2016 | Gutmann | B60W 30/09 340/907 |

OTHER PUBLICATIONS

International Preliminary Report on Patentability issued in PCT/US2017/034260, dated Jan. 3, 2019, 10 pages.

* cited by examiner

SYSTEMS AND METHODS FOR INTELLIGENT VEHICLE SPEED DETERMINATION

TECHNICAL FIELD

The present disclosure relates to an improved traffic flow control infrastructure using smart traffic control devices combined with intelligent vehicle technology.

BACKGROUND

Vehicle operator approaching traffic control devices such as traffic control signals, railroad crossing signals, and construction warning signals have little advance warning when the control device will change state. An operator, seeing a "proceed" signal in the distance (e.g., a "green" light, a dark railroad crossing sign, and/or a non-illuminated construction warning sign) will typically maintain speed or accelerate toward the device with the anticipation that the traffic control device will not change operating states prior to their arrival. However, at times, the traffic control device operating mode will change states, causing the vehicle operator to slow or even stop completely thereby reducing fuel efficiency by eliminating the benefit of the vehicular acceleration prior to arriving at the traffic control device. Conversely, a vehicle operator seeing a "stop" signal in the distance (e.g., a "red" light, an illuminated railroad crossing sign, or an illuminated construction sign may begin slowing or even braking in anticipation of eventually stopping at the traffic control device. If the traffic control device changes operating modes to a "proceed" state prior to the vehicle arriving at the traffic control device, the vehicle operator must once again accelerate, thereby reducing fuel efficiency due to the unnecessary slowing prior to the traffic control device.

Furthermore, the lack of knowledge of when a traffic control device will change state may result in vehicle operators passing the traffic control device as the traffic control device is in the process of changing states and/or after the traffic control device has changed states. Such behavior endangers not only the vehicle operator, but other vehicle operators in the area. Such behavior also results in erratic and/or uneven traffic patterns, causing or exacerbating traffic congestion and creating unsafe conditions.

BRIEF DESCRIPTION OF THE DRAWINGS

Features and advantages of various embodiments of the claimed subject matter will become apparent as the following Detailed Description proceeds, and upon reference to the Drawings, wherein like numerals designate like parts, and in which:

Figure 1:
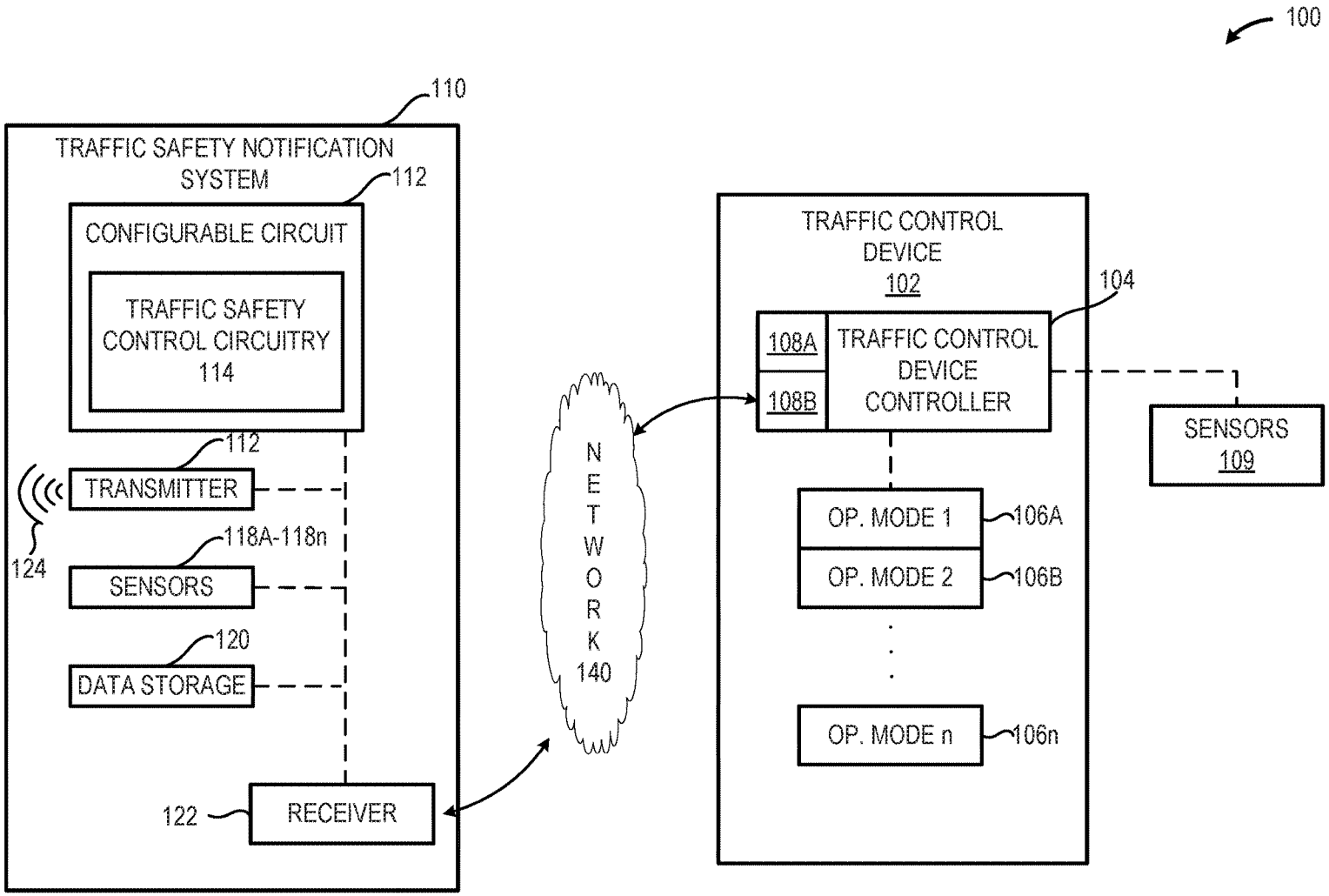
FIG. 1 is a block diagram of illustrative traffic safety notification system that includes a traffic control device and a communicably coupled traffic safety notification system, in accordance with at least one embodiment of the present disclosure.

Although the following Detailed Description will proceed with reference being made to illustrative embodiments, many alternatives, modifications and variations thereof will be apparent to those skilled in the art.

DETAILED DESCRIPTION

The systems and methods described herein provides an autonomous communication mechanism between a traffic control device and the vehicle(s) approaching the traffic control device. The traffic control device broadcasts a message that includes data indicative of the temporal interval or duration until the traffic control device will change operating modes. Such information beneficially and advantageously provides the vehicle operator with information to make an informed decision on whether to accelerate, decelerate, or maintain speed based on the operating mode of the traffic control device when the vehicle arrives at the traffic control device. By more intelligently approaching traffic control devices, fuel economy is improved, wear and tear on tires and brakes, accidents, and traffic congestion are all reduced, and traffic is able to flow more smoothly and efficiently.

In at least some implementations, the systems and methods described herein may include at least a transmitter that is communicably coupled to a traffic control device. The traffic control device may have a plurality of operating modes. For example, the traffic control device may have a first operating mode indicative of a green traffic signal (e.g., first operating mode) or a red traffic signal (e.g., second operating mode) in a direction of travel of a particular vehicle. The transmitter continuously, periodically, or aperiodically broadcasts a signal that includes data indicative of the time that the traffic control device will remain in the current operating mode (e.g., how much longer will the traffic signal be "RED" or "GREEN"?).

In at least some implementations, the systems and methods described herein may include a receiver that is carried by or operably coupled to a vehicle to receive the signal broadcast by the transmitted communicably coupled to the traffic control device. The system may additionally include one or more output devices (e.g., visual displays, audio outputs) capable of providing information contained in the received broadcast signal (e.g., time that the traffic control device will remain in the current state) in a human perceptible format. With a growing trend toward autonomously driven vehicles, such information may be routed to the onboard computer and used for speed control decision-making.

The systems described herein may include a transmitter communicably coupled to a traffic control device. The transmitter may communicate the current operating mode of the traffic control device and the time remaining for the traffic control device to remain in the current operating state. For traffic control devices that have a variable time remaining in the current operating state (e.g., traffic control devices that are hybrid time/event driven such as traffic lights that change state on a timer and based on traffic detected by roadway sensors), the transmitter may transmit a defined signal. For example, the transmitter may transmit a time value of "0 Seconds" until a change in operating mode. In another example, the transmitter may transmit a short message such as "Change on arrival of traffic" or similar. The transmitter may employ one or more transmission technologies to communicate information to approaching vehicles. The transmission range may typically be about one mile (1.6 km) or less. In some instances, the transmitter may utilize ort run on top of IEEE-1609 (infrastructure for vehicles) protocols.

The system described herein may include a receiver carried by a vehicle. The receiver may be a specialized receiver tuned to receive only the transmissions provided by transmitters communicably coupled to traffic control devices. The receivers may include logic that enables the receiver to differentiate between the transmitter associated with the direction of approach of the vehicle from the transmitters(s) associated with directions other than the direction of approach of the vehicle. In some implementations, the receivers may also include one or more vehicular sensors that provide the receiver with vehicle information such as current speed and acceleration to enable the receiver to present recommendations such as "slow down," "speed up," or "maintain speed" based on the current operating state of the traffic control device.

An intelligent infrastructure system is provided. The system may include a traffic control device transitionable between at least a first operating mode and a second operating mode and a traffic safety notification system operably coupled to the traffic control device. The traffic safety notification system may include transmitter circuitry; controller circuitry communicably coupled to the transmitter circuitry; at least one storage device communicably coupled to the controller circuitry and including machine-readable instructions, that when executed by the controller circuitry, transform the controller circuitry to traffic safety control circuitry, the traffic safety control circuitry to: determine a temporal interval remaining until a transition between traffic control device operating modes is to occur; and broadcast at least one message that includes data representative of the determined temporal interval.

A traffic safety device is provided. The traffic safety device may include transmitter circuitry; antenna circuitry communicably coupled to the transmitter circuitry; controller circuitry communicably coupled to the transmitter circuit, the controller circuitry including at least one interface communicably coupleable to a traffic control device transitionable among each of a plurality of operating modes; and at least one storage device communicably coupled to the controller circuitry and including machine-readable instructions, that when executed by the controller circuitry, transform the controller circuitry to traffic safety control circuitry, the traffic safety control circuitry to: determine a temporal interval remaining until a mode transition of the traffic control device between at least two of the plurality of operating modes; and broadcast at least one message that includes data representative of the determined temporal interval and data indicative of a geolocation of the traffic control device.

A vehicular safety control system is provided. The system may include receiver circuitry; a display device; antenna circuitry communicably coupled to the receiver circuitry; controller circuitry communicably coupled to the receiver circuitry and to the display device; and at least one storage device communicably coupled to the controller circuitry and including machine-readable instructions, that when executed by the controller circuitry, transform the controller circuitry to provide specialized vehicular safety control circuitry, the vehicular safety control circuitry to: receive a broadcast message from traffic safety control circuitry operably coupled to a traffic control device, the message including data representative of a temporal interval remaining until a traffic control device operating mode transitions between at least two of a plurality of operating modes; receive at least one vehicular signal that includes data representative of at least a current vehicular speed and a current distance between the vehicle and the traffic control device; autonomously determine whether the vehicle will arrive at the traffic control device prior to the transition in operating modes based at least on the temporal interval remaining until the transition in traffic control device operating modes, the vehicular speed and the distance between the vehicle and the traffic control device; and autonomously generate a display output on the display device indicative of whether the vehicle will arrive at the traffic control device prior to the transition in traffic control device operating modes.

A traffic safety method is provided. The method may include determining, by traffic safety control circuitry, a temporal interval remaining until an operating mode transition of a communicably coupled traffic control device from a current operating mode to a next operating mode; generating, by the traffic safety control circuitry, a message that includes data indicative of the determined temporal interval remaining until the communicably coupled traffic control device transitions from the current operating mode to the next operating mode; and broadcasting, by the traffic safety control circuitry, the generated message along at least one direction of approach to the traffic control device.

A traffic safety system is provided. The system may include: a means for determining a temporal interval remaining until a communicably coupled traffic control device transitions between a current operating mode and a next operating mode; a means for generating a message that includes data indicative of the determined temporal interval remaining until the communicably coupled traffic control device transitions from the current operating mode to the next operating mode; and a means for broadcasting the generated message.

A vehicular traffic safety method is provided. The method may include receiving, by the vehicular safety control circuitry, a broadcast message from traffic safety control circuitry operably coupled to a traffic control device, the broadcast message including data representative of a temporal interval remaining until a traffic control device operating mode transitions between at least two of a plurality of operating modes; receiving, by the vehicular safety control circuitry, at least one vehicular signal that includes data representative of at least a current vehicular speed and a current distance between the vehicle and the traffic control device; autonomously determining, by the vehicular safety control circuitry, whether the vehicle will arrive at the traffic control device prior to the transition in operating modes based at least on the temporal interval remaining until the transition in traffic control device operating modes, the vehicular speed, and the distance between the vehicle and the traffic control device; and autonomously generating, by the vehicular safety control circuitry, a display output on the display device indicative of whether the vehicle will arrive at the traffic control device prior to the transition in traffic control device operating modes.

A traffic safety system is provided. The system may include a means for determining a temporal interval remaining until an operating mode transition of a communicably coupled traffic control device from a current operating mode to a next operating mode; a means for generating a message that includes data indicative of the determined temporal interval remaining until the communicably coupled traffic control device transitions from the current operating mode to the next operating mode; and a means for broadcasting the generated message to at least one vehicle approaching the traffic control device.

A vehicular traffic safety system is provided. The system may include a means for receiving a broadcast message from traffic safety control circuitry operably coupled to a traffic control device, the broadcast message including data representative of a temporal interval remaining until a traffic control device operating mode transitions between at least two of a plurality of operating modes; a means for receiving at least one vehicular signal that includes data representative of at least a current vehicular speed and a current distance between the vehicle and the traffic control device; a means for autonomously determining whether the vehicle will arrive at the traffic control device prior to the transition in operating modes based at least on the temporal interval remaining until the transition in traffic control device operating modes, the vehicular speed, and the distance between the vehicle and the traffic control device; and a means for autonomously generating a display output on the display device indicative of whether the vehicle will arrive at the traffic control device prior to the transition in traffic control device operating modes.

As used herein, the terms "top," "bottom," "up," "down," "upward," "downward," "upwardly," "downwardly" and similar directional terms should be understood in their relative and not absolute sense. Thus, a component described as being "upwardly displaced" may be considered "laterally displaced" if the device carrying the component is rotated 90 degrees and may be considered "downwardly displaced" if the device carrying the component is inverted. Such implementations should be considered as included within the scope of the present disclosure.

As used in this application and in the claims, a list of items joined by the term "and/or" can mean any combination of the listed items. For example, the phrase "A, B and/or C" can mean A; B; C; A and B; A and C; B and C; or A, B and C. As used in this application and in the claims, a list of items joined by the term "at least one of" can mean any combination of the listed terms. For example, the phrases "at least one of A, B or C" can mean A; B; C; A and B; A and C; B and C; or A, B and C.

FIG. 1 is a block diagram of illustrative traffic safety notification system 100 that includes a traffic control device 102 and a communicably coupled traffic safety notification system 110, in accordance with at least one embodiment of the present disclosure. The traffic control device 102 may include a traffic control device controller circuit 104 that selectively places the traffic control device 102 into one of a number of operating modes 106A-106*n* (collectively, "operating modes 106"). In some implementations, the traffic control device controller circuit 104 may selectively place the traffic control device 102 into one of the plurality of operating modes 106 based at least in part on the passage of a defined temporal interval. For example, the traffic control device controller circuit 104 may place the traffic control device 102 in a first operating mode 106A for a period of 60 seconds, in a second operating mode 106B for a period of 3 seconds, and in a third operating mode 106C for a period of 60 seconds. In at least some implementations, the traffic control device controller circuit 104 proceeds through some or all of operating modes on a cyclical, repeating basis (e.g., in the prior example 106A-106B-106C-106B-106A-106B . . . ).

In some implementations, the traffic control device controller circuit 104 may selectively place the traffic control device 102 into one of the plurality of operating modes 106 based, at least in part, on the passage of a defined time interval and the detection of one or more defined events or conditions. For example, the traffic control device controller circuit 104 may place the traffic control device 102 in a first operating mode 106A for a period of 60 seconds prior to transitioning to a second operating mode 106B unless a communicably coupled sensor fails to detect an occurrence of one or more defined events or conditions. In such an instance, the traffic control device controller circuit 104 may hold the traffic control device 102 in the first operating state 106A until the event occurrence is detected or the condition is satisfied.

In some implementations, the traffic control device 102 may include any traffic control signal, device, system, indicator, or similar capable of controlling or affecting the flow of traffic past the traffic control device 102. The traffic control device 102 may include, but is not limited to, a traffic signal, a railroad crossing signal, a construction activity signal, a roadway hazard signal, a dangerous road condition signal, or any combination thereof. In one example, the traffic control device 102 may include at least one operating mode (e.g., a first operating mode 106A such as a GREEN light) that indicates to oncoming traffic traveling in the direction of the traffic control device 102 that it is safe to proceed along the thoroughfare and at least one operating mode (e.g., a second operating mode 106B such as a RED light) that indicates to oncoming traffic traveling in the direction of the traffic control device 102 that it is NOT safe to proceed along the thoroughfare.

In at least some implementations, at least one operating mode 106 may include an operating mode 106 in which the traffic control device is passive, inactive, unpowered, or not illuminated. For example, the traffic control device 102 may include at least one operating mode 106 in which the traffic control device 102 is not active or illuminated (e.g., a first operating mode 106A in which a railroad crossing warning is dark in the absence of a train approaching the grade crossing) and at least one operating mode 106 in which the traffic control device is active or illuminated (e.g., a second operating mode 106B in which the railroad crossing warning is illuminated when a train is detected approaching the grade crossing).

The traffic control device controller circuit 104 may include one or more communications interfaces 108. The one or more communications interfaces 108 may include one or more wired communications interfaces 108A or wireless communications interfaces 108B. The traffic control device controller circuit 104 may execute one or more machine-readable instruction sets that provide the control logic for the traffic control device 102. In implementations, the traffic control device controller circuit 104 may include a number of timer circuits used to determine the timing of changes in traffic control device operating mode 106. In such implementations, the traffic control device controller circuit 104 may transmit or otherwise communicate via the communications interface 108 at least one signal that includes data indicative of the time remaining until a change in operating mode 106 of the traffic control device 102.

In implementations, the traffic control device controller circuit 104 may include one or more sensors to detect an occurrence of an event or a fulfillment of a condition precedent for changing the operating mode 106 of the traffic control device 102. For example, one or more roadway traffic sensors may be communicably coupled to the traffic control device controller circuit 104. In such an example, the traffic control device controller circuit 104 may change the operating mode 106 of the traffic control device 102 only when one or more timers expire AND traffic is detected by the one or more roadway traffic sensors.

The traffic safety notification system 110 includes at least one configurable circuit 112 that may be configured using either hardware (e.g., a hardwired circuit) or software (e.g., a configurable controller or processor) capable of being configured to provide particular, dedicated, and specialized traffic safety control circuitry 114. In some implementations, all or a portion of the traffic safety notification system 110 may be collocated with the traffic control device 102. In other implementations, all or a portion of the traffic safety notification system 110 may be disposed remote from the traffic control device 102. The traffic safety control circuitry 114 may include and/or may be communicably coupled to one or more transmitters 116, one or more sensors 118A-118*n*, one or more data storage devices 120, and/or one or more receivers 122. In some implementations, the traffic safety control circuitry 114 may be wirelessly communicably coupled to the traffic control device controller circuit 104 via one or more networks 140. Although not depicted in FIG. 1, in other implementations, the traffic safety control circuitry 114 may be tethered to the traffic control device controller circuit 104 via one or more wired connections.

In some implementations, the configurable circuit 112 may include any number and/or combination of electronic components and/or semiconductor devices. In some implementations, the configurable circuit may include one or more Application Specific Integrated Circuits (ASICs); one or more Digital Signal Processors (DSPs); one or more Reduced Instruction Set Computers (RISCs); one or more Systems on a Chip (SoCs); one or more single- or multi-core processors; one or more single- or multi-core microprocessors; one or more Programmable Gate Arrays (PGAs); one or more hardwired circuits; or combinations thereof. In some implementations, the configurable circuit 112 may execute one or more machine-readable instruction sets that configure and physically transform all or a portion of the configurable circuit 112 to particular and specialized traffic safety control circuitry 114.

One or more transmitters 116 may be communicably coupled to the traffic safety control circuitry 114. The one or more transmitters 116 may include any number and/or combination of wireless transmitters capable of communicating or broadcasting one or more signals 124 to vehicular traffic. One or more antennas or similar electrically conductive structures may be communicably coupled to the one or more transmitters 116.

A plurality of transmitters 116 may be communicably coupled to the traffic safety control circuitry 114. In such implementations, each of a corresponding plurality of antennas may be communicably coupled to one of the plurality of transmitters 116. Each of the plurality of antennas may include a directional antenna configured such that the signal transmitted via the respective antenna propagates in a narrowly focused beam along a direction of vehicular travel towards the traffic control device 102. For example, a traffic control device 102 such as a four-way traffic light may include four different transmitters 116. Each of the transmitters 116 may be communicably coupled to a respective directional antenna to communicate the same or different messages to vehicles approaching the traffic control device 102 from each of four different directions.

One or more sensors 118A-118*n* (collectively, "sensors 118") may be communicably coupled to the traffic safety control circuitry 114. The sensors 118 may include one or more environmental sensors capable of detecting at least one environmental condition proximate the traffic control device 102. Such environmental conditions may include, but are not limited to, rain, snow, ice, and fog. The sensors 118 may include one or more sensors capable of detecting one or more roadway or road surface conditions that affect vehicle handling and/or performance proximate the traffic control device. Such roadway conditions may include, but are not limited to, roadway conditions that impact stopping distance such as rain, snow, sleet, sand, gravel, and the like. The sensors 118 may include one or more sensors capable of detecting the presence of vehicular and/or pedestrian traffic at the traffic control device 102. The sensors 118 may include one or more sensors capable of detecting the departure, passage, and/or arrival of an obstruction (e.g., construction equipment, emergency response vehicles, and similar) proximate the traffic control device 102.

Each sensor 118 may generate a signal that includes data or information regarding the sensed condition to the traffic safety control circuitry 114. The signal may be wirelessly communicated from the sensor 118 to the traffic safety control circuitry 114 or, at least in some instances, the sensor 118 may be hardwired to the traffic safety control circuitry 114 and the signal may be communicated from the sensor 118 to the traffic safety control circuitry 114 via the hardwire connection.

One or more data storage devices 120 may be communicably coupled to the traffic safety control circuitry 114. The data storage devices 120 may include one or more solid state drives, one or more rotating media drives (magnetic, electromagnetic, optical, etc.) or any other memory device, component, hardware, or system capable of storing or otherwise retaining data and/or information. The data storage devices 120 may store or otherwise retain information and/or data generated and/or used by the traffic safety control circuitry 114. The data storage devices 120 may store or otherwise retain machine-readable instruction sets that may be executed by the configurable circuit 112 to provide the traffic safety control circuitry 114.

One or more receivers 122 may be communicably coupled to the traffic safety control circuitry 114. The receivers 122 may communicably couple the traffic safety control circuitry 114 to the traffic control device controller circuit 104. The receivers 122 may provide over-the-air updates to the traffic safety control circuitry 114. The receivers 122 may include one or more emergency response vehicle receivers that detect the approach of emergency response vehicles.

Figure 2:
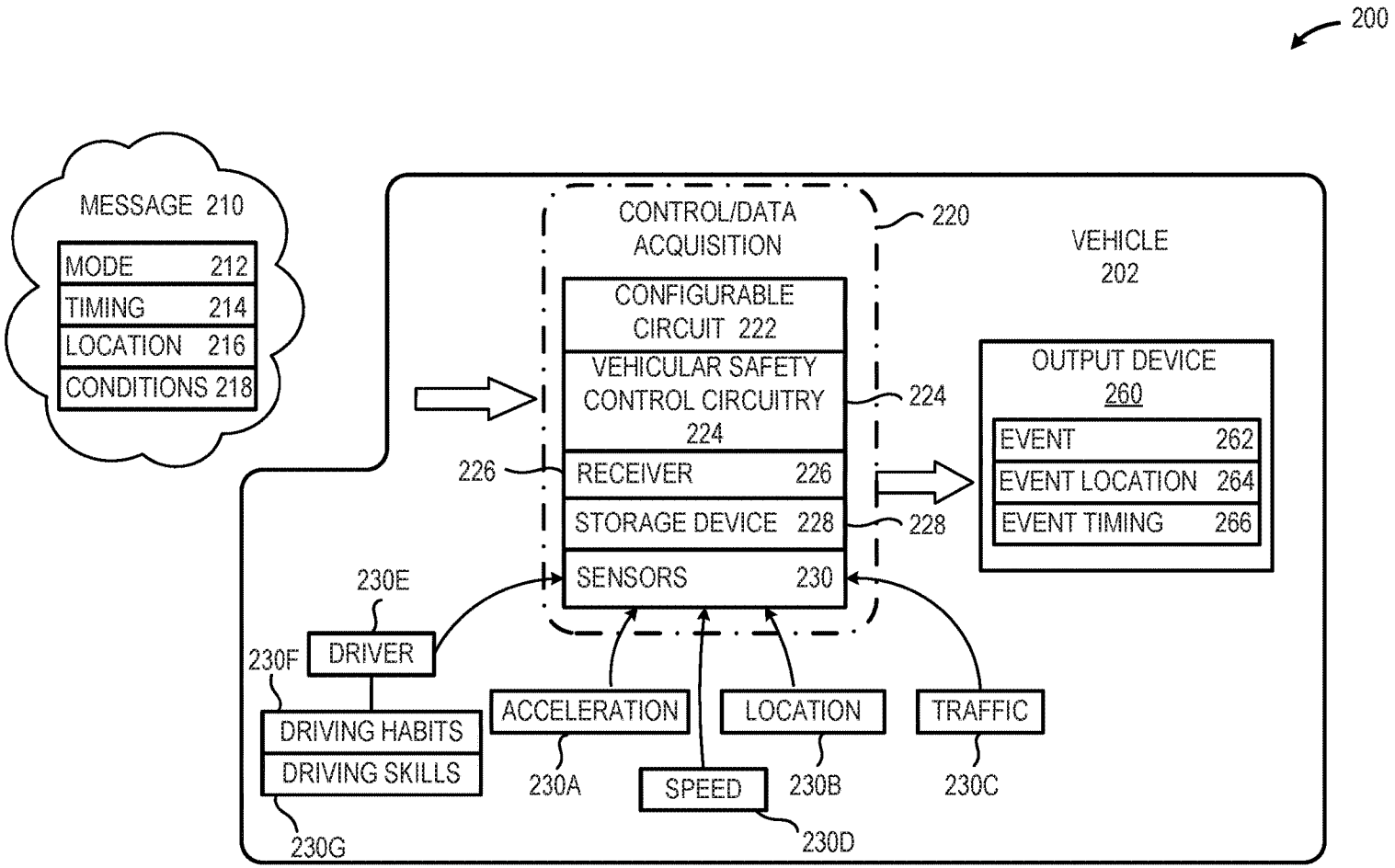
FIG. 2 is a block diagram of an illustrative system that includes a vehicle to receiver one or more signals broadcast by a traffic safety notification system such as that depicted in FIG. 1, in accordance with at least one embodiment of the present disclosure.

FIG. 2 is a block diagram of an illustrative system 200 that includes a vehicle 202 to receiver one or more signals 210 broadcast by a traffic safety notification system 110 such as that depicted in FIG. 1, in accordance with at least one embodiment of the present disclosure. The traffic safety control circuitry 114 transmitter 112 broadcasts or otherwise transmits a message 210 that is received by a receiver 226 carried by vehicle 202. The message 210 broadcast by the traffic safety notification system 110 may include data and/or information indicative of some or all of the following: traffic control device current operating mode data and/or information 212; traffic control device next (i.e., immediately following the current operating mode) operating mode data and/or information 212; the current traffic control device operating mode time remaining data and/or information 214; the traffic control device location data and/or information 216; traffic control device condition data and/or information 218.

The vehicle 202 may include one or more control and/or data acquisition systems 220. Such a vehicular control system may include a configurable circuit 222 capable of executing machine-readable instruction sets that physically transform at least a portion of the configurable circuit 222 to the vehicular safety control circuitry 224. The vehicular control/data acquisition system 220 may include one or more communicably coupled receivers 226 to receive the message 210 broadcast by the traffic safety notification system transmitter 112. The vehicular control/data acquisition system 220 may include one or more communicably coupled data storage devices 228 that store or otherwise retain data and/or information used or generated by the vehicular safety control circuitry 224 and/or the machine-readable instruction sets executed by the configurable circuit 222 to provide the vehicular safety control circuitry 224.

The vehicular control/data acquisition system 220 may include any number of sensors 230A-230*n* (collectively, "sensors 230"). In embodiments, these sensors 230 may include one or more sensors capable of providing one or more output signals that include data or information indicative of: vehicular acceleration 230A; vehicular location 230B; vehicular speed 230C; vehicular and/or pedestrian traffic proximate the vehicle 203D; driver biometric information 230E; historical driving habits of the driver 230F; and a level of driving skill of the driver 230G.

Upon receipt of the message 210 from the traffic safety notification system 110, the vehicular safety control circuitry 224 determines whether the vehicle 202 is able to reach the traffic control device 102 prior to the change in operating state of the traffic control device 102. In a basic implementation, the vehicular safety control circuitry 224 determines the time needed for the vehicle 202 to reach the traffic control device 102 (e.g., based on the speed of the vehicle 202 and the distance between the vehicle 202 and the traffic control device 102) is less than the time remaining until the traffic control device 102 changes operating mode. If the time required to reach the traffic control device 102 is less than the time remaining until the traffic control device 102 changes operating mode, the vehicular safety control circuitry 224 displays a message on an output device 260 indicating that it is safe to proceed at the current speed and slowing is not necessary. Conversely, if the time required to reach the traffic control device 102 is greater than or equal to than the time remaining until the traffic control device 102 changes operating mode, the vehicular safety control circuitry 224 displays a message on an output device 260 indicating that it is NOT safe to proceed and that the vehicle should be slowed in anticipation of the upcoming change in operating state of the traffic control device.

In some implementations, additional factors may be considered by the vehicular safety control circuitry 224 in making the determination of whether the vehicle 202 will arrive at the traffic control device 102 prior to a change in operating state of the traffic control device 102. For example, the message 210 may include data indicative of roadway conditions 218 proximate the traffic control device 102. When roadway condition information is included in the message 210, the vehicular safety control circuitry 224 may consider the effects of vehicular stopping distance in determining whether to recommend maintaining speed, accelerating, or decelerating/braking prior to arrival at the traffic control device 102. In another example, the vehicular safety control circuitry 224 may evaluate vehicular and/or pedestrian traffic 230D proximate the vehicle to determine whether to recommend maintaining speed, accelerating, or decelerating/braking prior to arrival at the traffic control device 102. In another example, the vehicular safety control circuitry 224 may evaluate driver biometrics 230E using a number of biometric sensors positioned throughout the vehicle 202 and incorporate the physical and/or mental (e.g., fatigued, distracted) condition of the vehicle operator in making the determination whether to recommend maintaining speed, accelerating, or decelerating/braking prior to arrival at the traffic control device 102. In yet another example, the vehicular safety control circuitry 224 may evaluate vehicle operator habits 230F and/or driving skills 230G in making the determination whether to recommend maintaining speed, accelerating, or decelerating/braking prior to arrival at the traffic control device 102.

The vehicular safety control circuitry 224 generates a recommendation and presents the recommendation to the vehicle operator via one or more output devices 260 in vehicle 202. The recommendation provided by the vehicular safety control circuitry 224 may include information and/or data indicative of the event associated with the change in operating mode of the traffic control device 102 (change in traffic signal from GREEN to RED; construction equipment entering roadway, etc.). The recommendation provided by the vehicular safety control circuitry 224 may include information and/or data indicative of the event location associated with the change in operating mode of the traffic control device 102 (e.g., a distance to the traffic control device 102). The recommendation provided by the vehicular safety control circuitry 224 may include information and/or data indicative of the time remaining 266 prior to the change in operating state of the traffic control device 102. In at least some implementations, the recommendation provided by the vehicular safety control circuitry 224 may include a continuously, periodically (e.g., once per second, twice per second, one per 2 seconds) or aperiodically updated information and/or data indicative of the time remaining 266 prior to the change in operating state of the traffic control device 102.

Figure 3:
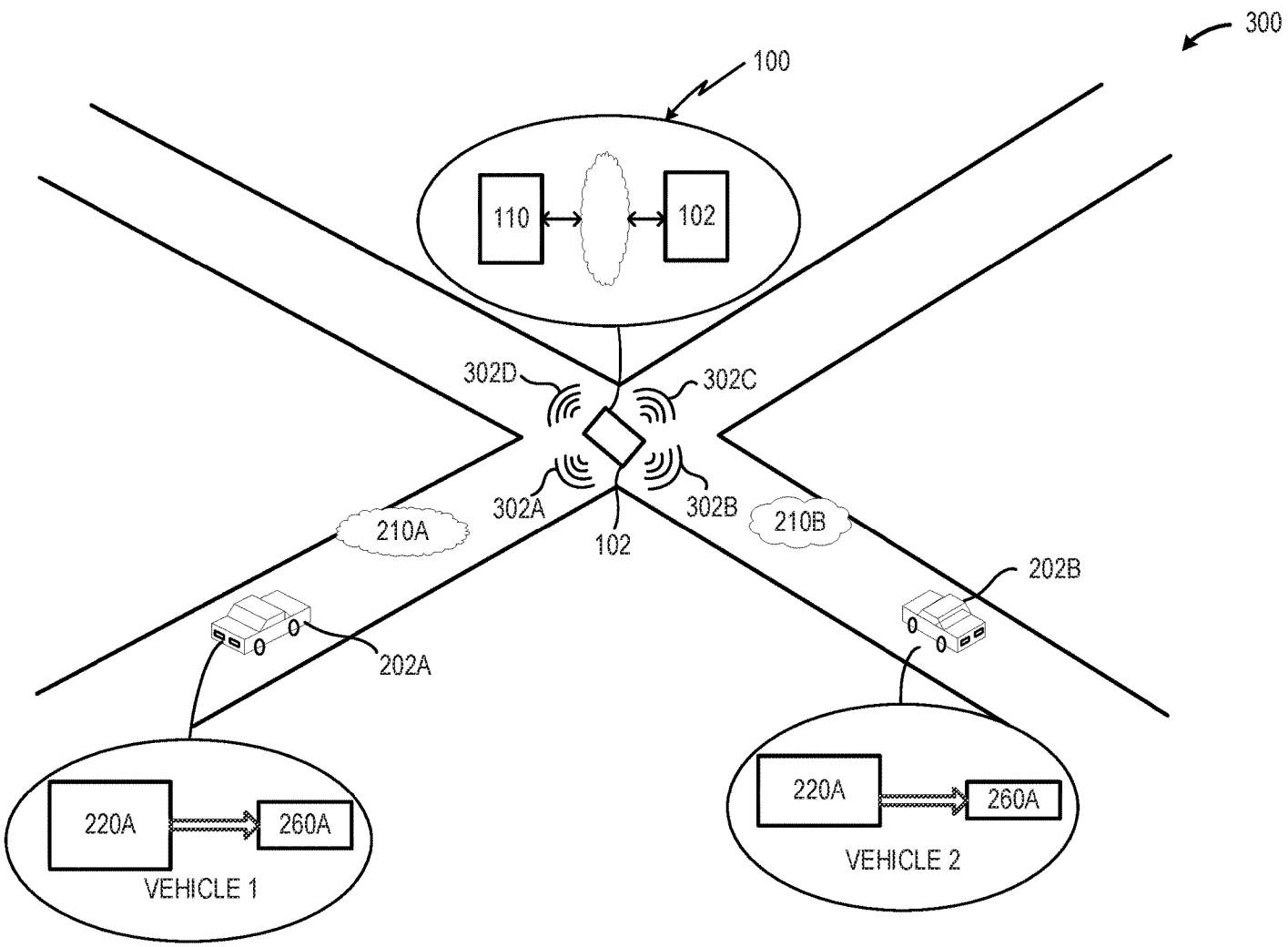
FIG. 3 is a schematic diagram of an illustrative traffic safety system that includes an illustrative traffic safety notification system and two illustrative vehicles, each of which includes a respective vehicular control/data acquisition system coupled to a respective output device, in accordance with at least one embodiment of the present disclosure.

FIG. 3 is a schematic diagram of an illustrative traffic safety system 300 that includes an illustrative traffic safety notification system 100 and two illustrative vehicles 202A and 202B, each of which includes a respective vehicular control/data acquisition system 220A and 220B coupled to a respective output device 260A and 260B, in accordance with at least one embodiment of the present disclosure. The traffic safety notification system 100 broadcasts 302A-302D a message in each direction of approach. In some implementations, a single message 210 having common data and/or information may be broadcast in some or all possible directions of approach to the traffic control device 102. In some implementations, different messages 210A-210*n* may be broadcast in each of some or all possible directions of approach to the traffic control device 102.

In the scenario depicted in FIG. 3, in one embodiment, messages 210A and 210B may each include similar or identical information and/or data, such as data indicative of the time remaining until the traffic control device 102 changes operating mode (e.g., "Upcoming traffic control device will change operating mode in X seconds."). In another embodiment, messages 210A and 210B may each include different information and/or data, such as data indicative of the current state of traffic control device 102 and the future state of traffic control device 102. Thus, the output device 260A in vehicle 202A may output a message such as "Upcoming traffic control device 102 will change from MODE1 to MODE2 in X seconds." In contrast, output device 260B in vehicle 202B may output a message such as "Upcoming traffic control device 102 will change from MODE2 to MODE1 in X seconds."

Furthermore, the vehicular safety control circuitry 224A in vehicle 202A may provide additional information to the vehicle operator based on vehicular parameters such as vehicle speed, acceleration, distance to traffic control device 102, roadway speed limit, driver skill level, driver biometrics, and/or driver habits. In addition, message 210A may include additional data indicative of environmental conditions at traffic control device 102, vehicular traffic at traffic control device 102, and/or pedestrian traffic at traffic control device 102, some or all of which may be considered by the vehicular safety control circuitry 224 in determining whether to recommend maintain speed, accelerating, or decelerating on approach to the traffic control device 102. The vehicular safety control circuitry 224 in each vehicle 202 approaching the traffic control device 102 may provide recommendations to each respective vehicle 202 based on similar factors and/or conditions along the direction of travel/direction of approach of each respective vehicle 202 to the traffic control device 102.

Figure 4:
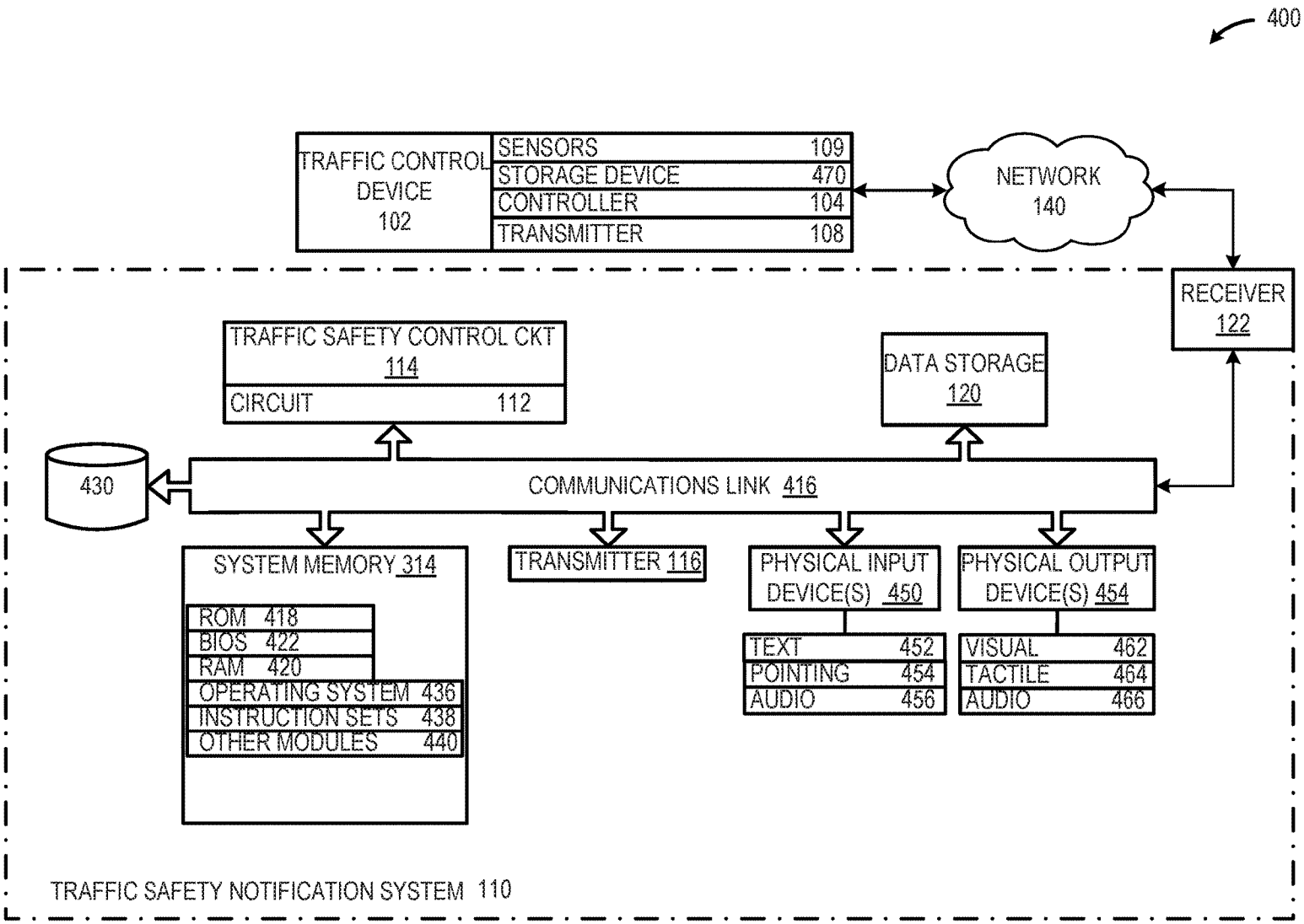
FIG. 4 and the following discussion provide a brief, general description of an example processor-based device that, in operation, hosts an illustrative traffic safety notification system, in accordance with at least one embodiment of the present disclosure.

FIG. 4 and the following discussion provide a brief, general description of an example processor-based device 400 that, in operation, hosts an illustrative traffic safety notification system 110, in accordance with at least one embodiment of the present disclosure. The processor-based device 400 may include one or more processors and/or configurable circuits 112 physically transformable or transitionable to provide the traffic safety control circuitry 114. Although not required, some portion of the embodiments will be described in the general context of machine-readable or computer-executable instruction sets, such as program application modules, objects, or macros being executed by the traffic safety control circuitry 114. As depicted in FIG. 4, the traffic safety control circuitry 114 may include various subcomponents, circuitry, modules, or subsystems, such as transmitter and/or transceiver circuitry that forms at least a portion of the transmitter subsystem 116, sensor interface circuitry that forms at least a portion of the sensor subsystem 118, receiver and/or transceiver circuitry that forms at least a portion of the receiver subsystem 122. Such circuitry may be implemented in the form of hardwired circuits, programmable circuits, configurable controllers, digital signal processors, single- or multi-core processors, single- or multi-core microprocessors, systems on a chip (SoC), or combinations thereof.

Those skilled in the relevant art will appreciate that the illustrated traffic notification system 110 may be practiced and/or implemented using other circuit-based device configurations, including portable electronic or handheld electronic devices, for instance smartphones, portable computers, wearable computers, microprocessor-based or programmable consumer electronics, personal computers ("PCs"), network PCs, minicomputers, mainframe computers, and the like. The traffic safety notification system 110 may be practiced and/or implemented in distributed computing environments where tasks or modules are performed by remote processing devices, which are linked through a communications network. In a distributed computing environment, program modules may be located in both local 120 and remote memory storage devices 430.

The traffic safety notification system 110 may include any number of configurable circuits 112, some or all of which may include a variety of electronic and/or semiconductor components that are disposed partially or wholly in a portable computing device, personal computer, workstation, industrial computer, hardened controller, or other similar current or future processor-based devices and/or systems capable of executing machine-readable instruction sets capable of transforming at least a portion of the number of configurable circuits 112 into the traffic safety control circuitry 114.

The number of configurable circuits 112 may be interconnected with, electrically coupled, and/or communicably coupled to various components within the traffic safety notification system 110 via one or more communications links 416. As depicted in FIG. 4, system components such as a system memory 414 may be communicably coupled to each of the number of configurable circuits 112 via the one or more communications links 416. The traffic safety notification system 110 may, at times, be referred to in the singular herein, but this is not intended to limit the embodiments to a single system, since in certain embodiments, there will be more than one traffic safety notification system 110 or other networked systems, circuits, or devices involved.

Each of the number of configurable circuits 112 may include any number, type, or combination of conductors, insulators, electrical devices, and/or semiconductor components. At times, each of the number of configurable circuits 112, including all or a portion of the traffic safety control circuitry 114, may be implemented in whole or in part in the form of semiconductor devices such as diodes, transistors, inductors, capacitors, and resistors. Such an implementation may include, but is not limited to any current or future developed single- or multi-core processor or microprocessor, such as: one or more systems on a chip (SOCs); one or more central processing units (CPUs); one or more digital signal processors (DSPs); one or more graphics processing units (GPUs); one or more application-specific integrated circuits (ASICs), one or more field programmable gate arrays (FPGAs), and the like. Unless described otherwise, the construction and operation of the various blocks shown in FIG. 4 are of conventional design. As a result, such blocks need not be described in further detail herein, as they will be understood by those skilled in the relevant art. The one or more communications links 416 that interconnects at least some of the components may employ any known serial or parallel bus structures or architectures.

In some implementations, the traffic safety control circuitry 114 may include a number of circuits, sub-systems, or similar structures. In such implementations, the traffic safety control circuitry 114 may include transmitter circuitry 116 to broadcast a message 210 to vehicular traffic approaching the traffic control device 102. In at least some implementations, the transmitter circuitry 116 may broadcast 124 a message 210 using a directional antenna such that only vehicles 202 approaching the traffic control device 102 along a defined direction of approach receive the message 210. In some implementations, the traffic safety control circuitry 114 may include a plurality of transmitter circuits 116A-116*n*. In such instances, each of the plurality of transmitter circuits 116A-116*n* may be coupled to a directional antenna such that the message 210 broadcast by each of the plurality of transmitter circuits 116A-116*n* may travel along a different direction of approach to the traffic control device 102. The transmitter circuitry 116 may be compliant with one or more industry standard communications protocols, for example IEEE 1609.0-2013 standards for Wireless Access in Vehicular Environments (WAVE), latest version.

In some implementations, the power of the transmitted message 210 may be controlled or otherwise curtailed to limit the broadcast range of the message 210 to a defined area and/or a defined range along the direction of approach to the traffic control device 102. For example, transmitter power may be limited to provide an effective broadcast range of up to: about 0.1 miles or less; about 0.25 miles or less; about 0.5 miles or less; about 0.75 miles or less; or about 1 mile or less.

The traffic safety control circuitry 114 may additionally include sensor interface circuitry 118 capable of receiving signals from any number of local or remote sensors. In some implementations, the sensor interface circuitry 118 may provide power to some or all of the sensors. In some implementations, some or all of the sensors may be self-powered. Example sensors may include, but are not limited to, one or more environmental sensors to detect one or more parameters (temperature, humidity, visibility, roadway conditions, precipitation, etc.) in the environment local to the traffic safety notification system 110.

The traffic safety control circuitry 114 may additionally include receiver circuitry 122 to receive data from the traffic control device 102, one or more sensors, and/or vehicles 202. The receiver circuitry 122 may include one or more wireless receiver circuits, one or more wired receiver circuits or any combination thereof. In some implementations, the communication between the traffic control device 102 and the traffic safety control circuitry 114 may include information and/or data indicative of one or more of the following: the current operating state of the traffic control device 102, the next operating state of the traffic control device 102, and the time the traffic control device 102 will remain in the current operating state. In some instance, the receiver circuitry 122 may include one or more emergency responder receivers capable of receiving traffic control device 102 control signals from emergency response vehicles as they approach the traffic control device 102. For example, in some implementations, an emergency response vehicle may cause the traffic control device 102 to prematurely change operating states (e.g., switch from a RED/STOP operating state to a GREEN/GO operating state prior to the timeout of the RED operating state).

The system memory 414 may include read-only memory ("ROM") 418 and random access memory ("RAM") 420. A portion of the ROM 418 may contain a basic input/output system ("BIOS") 422. The BIOS 422 may provide basic functionality to the traffic safety notification system 110, for example by causing at least some of the one or more configurable circuits 112 to load one or more machine-readable instruction sets that cause at least one of the one or more configurable circuits 112 to provide the traffic safety control circuitry 114.

The traffic safety notification system 110 may include one or more communicably coupled, non-transitory, data storage devices 120. The one or more data storage devices 120 may include any number and/or combination of any current or future developed non-transitory storage devices. Non-limiting examples of such non-transitory, data storage devices 120 may include, but are not limited to one or more magnetic storage devices, one or more optical storage devices, one or more solid-state electromagnetic storage devices, one or more electroresistive storage devices, one or more molecular storage devices, one or more quantum storage devices, or various combinations thereof.

The one or more storage devices 120 may include interfaces or controllers (not shown) communicatively coupling the respective storage device(s) 120 to the one or more communications links 416, as is known by those skilled in the art. The one or more storage devices 120 may store, retain, or otherwise include a number of machine-readable instruction sets, data structures, program modules, and other data useful to the node 102.

In some instances, one or more external storage devices 430 may be communicably coupled to the traffic safety notification system 110. In one example, the one or more external storage devices 430 may include one or more remote server based storage devices or "cloud" storage devices that are bidirectionally communicably coupled to the traffic safety notification system 110 via one or more wireless networks (e.g., IEEE 802.11 "Wi-Fi"), one or more wired networks (e.g., IEEE 802.3 "Ethernet"), or combinations thereof.

At least one traffic control device 102 may be communicably coupled to the traffic safety control circuitry 114 via a wired or wireless network 140 communicably coupled to a communications interface 108 in the traffic control device 102 and to the receiver circuitry 122 in the traffic safety notification system 110. In at least some implementations, the traffic control device 102 coupled to the traffic safety notification system 110 may autonomously communicate data and/or information indicative of the current operating mode of the traffic control device 102, the nest operating mode of the traffic control device 102, and the time that the traffic control device 102 will remain in the current operating state. In embodiments, the traffic control device 102 may include one or more sensors 109, one or more traffic control device controllers 104, and one or more storage devices 470 that store or otherwise retain data and/or information generated and/or used in operating the traffic control device 102 and store or otherwise retain machine-readable instruction sets used by the traffic control device controller 104 in controlling the operating modes of the traffic control device 102 according to a defined schedule or program.

Machine-readable instruction sets and/or applications 438 and housekeeping instruction sets 440 may be stored or otherwise retained in whole or in part in the system memory 414. Such instruction sets may be transferred from one or more data storage devices 120 and/or one or more external storage devices 430 and stored in the system memory 414 in whole or in part for execution by at least one of the one or more configurable circuits 112.

The machine-readable instruction sets 438 may include instructions and/or logic that provide the traffic safety control circuitry 114 with the capability to receive operating mode information and/or data from the traffic control device 102 and transform the received operating mode information and/or data into a message 210 that may be transmitted to a vehicle 202 approaching the traffic control device 102.

The machine-readable instruction sets 438 may further include instructions and/or logic that provide the traffic safety control circuitry 114 with the capability to receive one or more signals containing data and/or information from sensors communicably coupled to the traffic safety control circuitry 114 and transform the received information and/or data into a message 210 that may be transmitted to a vehicle 202 approaching the traffic control device 102. For example, the machine-readable instruction sets 438 may include instructions and/or logic that provide the traffic safety control circuitry 114 with the capability to receive one or more signals containing data and/or information from vehicular traffic sensors and/or pedestrian traffic sensors positioned proximate the traffic control device 102, transform the received vehicular and/or pedestrian traffic data into a format for transmission 124 to a vehicle 202 approaching the traffic control device 102. Such may beneficially permit the vehicle operator to proactively take appropriate action based on the vehicular traffic and/or pedestrian traffic present at the traffic control device 102.

The machine-readable instruction sets 438 may further include instructions and/or logic that provide the traffic safety control circuitry 114 with the capability to determine whether vehicular traffic remains stationary at the traffic control device 102. In some instances, when no stationary traffic is detected by the traffic safety control circuitry 114, the traffic control device 102 may remain in the current operating state beyond the determined time remaining. A traffic light at a 4-way intersection formed by a street and cross-street may operate on timed cycles when traffic is detected as present. Operational control of the light may transition to vehicle sensors embedded in the roadway when traffic is light such that the light for the street will remain GREEN until a vehicle is detected at the cross street—at which time, the signal will change to RED and the vehicle on the cross street will be provided the GREEN signal. In such implementations, the traffic safety control circuitry 114 may broadcast a time interval value of "0" to warn approaching vehicles that the traffic control device 102 may transition between operating modes upon a detected approach (e.g., using traffic sensors embedded in the roadway) of a vehicle to the traffic control device 102.

The traffic safety notification system 110 may include one or more communicably coupled physical input devices 450, such as one or more text entry devices 452 (e.g., keyboard), one or more pointing devices 454 (e.g., mouse, trackball, touchscreen), and/or one or more audio input devices 456. Such physical input devices 450 may be used, for example, to provide, enter, or otherwise supply commands (e.g., acknowledgements, selections, confirmations, and similar) as well as information (e.g., acknowledgements, corrected subject identifiers, and similar) to the traffic safety control circuitry 114.

The traffic safety notification system 110 may include one or more communicably coupled physical output devices 460, such as one or more visual output devices 462 (e.g., a display device), one or more tactile output devices 464 (e.g., haptic feedback or similar), one or more audio output devices 466, or combinations thereof.

For convenience, the traffic safety control circuitry 114, receiver circuitry 122, the data storage 120, the system memory 414, the transmitter circuitry 116, the physical input devices 450 and the physical output devices 460 are illustrated in FIG. 4 as communicatively coupled to each other via the one or more communications links 416, thereby providing connectivity between the above-described components. In alternative embodiments, the above-described components may be communicatively coupled in a different manner than illustrated in FIG. 4. For example, one or more of the above-described components may be directly coupled to other components, or may be coupled to each other, via one or more intermediary components (not shown). In some embodiments, the one or more communications links 416 may be omitted and the components are coupled directly to each other using suitable wired or wireless connections.

Figure 5:
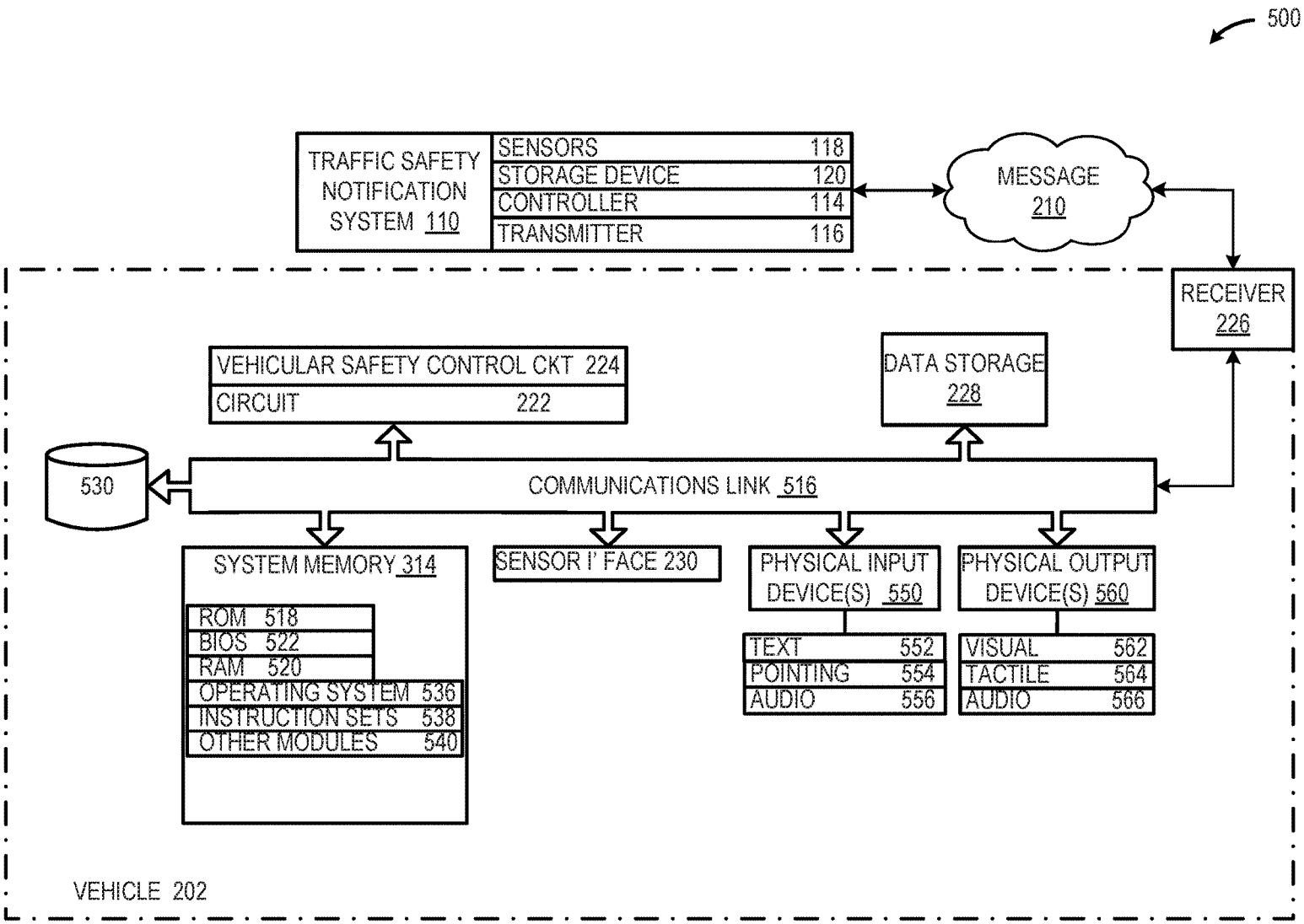
FIG. 5 and the following discussion provide a brief, general description of an example processor-based device that, in operation, hosts an illustrative vehicular control/data acquisition system, in accordance with at least one embodiment of the present disclosure.

FIG. 5 and the following discussion provide a brief, general description of an example processor-based device 500 that, in operation, hosts an illustrative vehicular control/data acquisition system 220, in accordance with at least one embodiment of the present disclosure. The processor-based device 500 may include one or more processors and/or configurable circuits 222 physically transformable or transitionable to provide the vehicular safety control circuitry 224. Although not required, some portion of the embodiments will be described in the general context of machine-readable or computer-executable instruction sets, such as program application modules, objects, or macros being executed by the vehicular safety control circuitry 224. As depicted in FIG. 5, the vehicular safety control circuitry 224 may include various subcomponents, circuitry, modules, or subsystems, such as receiver and/or transceiver circuitry that forms at least a portion of the receiver subsystem 226 and/or sensor interface circuitry that forms at least a portion of the sensor subsystem 230. Such circuitry may be implemented in the form of hardwired circuits, programmable circuits, configurable controllers, digital signal processors, single- or multi-core processors, single- or multi-core microprocessors, systems on a chip (SoC), or combinations thereof.

Those skilled in the relevant art will appreciate that the vehicular control/data acquisition system 220 may be practiced and/or implemented using other circuit-based device configurations, including portable electronic or handheld electronic devices, for instance smartphones, portable computers, wearable computers, microprocessor-based or programmable consumer electronics, personal computers ("PCs"), network PCs, minicomputers, mainframe computers, and the like. The vehicular control/data acquisition system 220 may be practiced and/or implemented in distributed computing environments where tasks or modules are performed by remote processing devices, which are linked through a communications network. In a distributed computing environment, program modules may be located in both local and remote memory storage devices. In embodiments, the vehicle safety vehicle safety control and/or data acquisition system(s) 220 may be implemented in a networked distributed computing environment across a plurality of vehicles 202.

The vehicular control/data acquisition system 220 may include any number of configurable circuits 222, each of which may include a variety of electronic and/or semiconductor components that are disposed partially or wholly in a wearable computer, portable computing device, personal digital assistant, personal computer, or other similar current or future processor-based devices and/or systems capable of executing machine-readable instructions.

The number of configurable circuits 222 may be interconnected with, electrically coupled, and/or communicably coupled to various components within the vehicular control/data acquisition system 220 via one or more communications links 516, such as a controller area network bus ("CAN bus"). In at least some implementations, the configurable circuit 222 may be disposed in whole or in part within a vehicular "head unit" or similar structure that houses electrical and/or control components. As depicted in FIG. 5, system components such as a system memory 514 may be communicably coupled to each of the number of configurable circuits 222 via the one or more communications links 516. The vehicular control/data acquisition system 220 may, at times, be referred to in the singular herein, but this is not intended to limit the embodiments to a single system, since in certain embodiments, there will be more than one vehicular control/data acquisition system 220 or other networked systems, circuits, or devices involved.

Each of the number of configurable circuits 222 may include any number, type, or combination of conductors, insulators, electrical devices, and/or semiconductor components. At times, each of the number of configurable circuits 222, including all or a portion of the vehicular safety control circuitry 224, may be implemented in whole or in part in the form of semiconductor devices such as diodes, transistors, inductors, capacitors, and resistors. Such an implementation may include, but is not limited to any current or future developed single- or multi-core processor or microprocessor, such as: one or more systems on a chip (SOCs); one or more central processing units (CPUs); one or more digital signal processors (DSPs); one or more graphics processing units (GPUs); one or more application-specific integrated circuits (ASICs), one or more field programmable gate arrays (FPGAs), and the like. Unless described otherwise, the construction and operation of the various blocks shown in FIG. 5 are of conventional design. As a result, such blocks need not be described in further detail herein, as they will be understood by those skilled in the relevant art. The one or more communications links 516 that interconnects at least some of the components may employ any known serial or parallel bus structures or architectures.

In some implementations, the vehicular safety control circuitry 224 may include a number of circuits, sub-systems, modules, or similar physical devices and/or structures. In such implementations, the vehicular safety control circuitry 224 may include receiver circuitry 226 to receive data and/or information in the form of a message 210 generated and transmitted by the traffic safety control circuitry 114. In at least some implementations, the receiver circuitry 226 may communicate using one or more industry standard communications protocols, for example IEEE 1609.0-2013 (latest version).

The vehicular safety control circuitry 224 may additionally include event sensor interface circuitry 230 to receive one or more signals from sensors 230A-230*n* carried by the vehicle 202. In some implementations, the sensor interface circuitry 230 may include one or more bus interfaces (e.g., a CAN bus interface). Such sensors 230A-230*n* may include, but are not limited to: one or more vehicular acceleration sensors 230A; one or more geolocation sensors 230B (e.g., Global Positioning System or GPS receivers); one or more vehicular traffic and/or pedestrian traffic sensors 230C; one or more vehicular speed sensors 230D, one or more vehicle operator biometric sensors 230E; one or more vehicle operator driving habits sensors 230F; and one or more vehicle operator driving skills sensors 230G.

The vehicular safety control circuitry 224 may additionally include output circuitry 260 to provide a human perceptible output to the vehicle operator. In embodiments, such output may include an audio or visual output that provides the vehicle operator with information about the current operating state of the traffic control device 102, the next operating state of the traffic control device 102, and the time remaining until the traffic control device 102 changes from the current operating state to the next operating state. In embodiments, such output may include an audio or visual output that provides the vehicle operator with information indicative of whether the vehicle should accelerate, decelerate/brake, or maintain speed based on the time remaining until the traffic control device 102 changes from the current operating state to the next operating state. In embodiments, such output may include an audio or visual output that provides the vehicle operator with information indicative of vehicular traffic, pedestrian traffic, and/or environmental conditions proximate the traffic control device 102.

The system memory 514 may include read-only memory ("ROM") 518 and random access memory ("RAM") 520. A portion of the ROM 518 may contain a basic input/output system ("BIOS") 522. The BIOS 522 may provide basic functionality to the vehicular control/data acquisition system 220, for example by causing at least some of the one or more configurable circuits 222 to load one or more machine-readable instruction sets that cause at least one of the one or more configurable circuits 222 to provide the vehicular safety control circuitry 224.

The vehicular control/data acquisition system 220 may include one or more communicably coupled, non-transitory, data storage devices 228. The one or more data storage devices 228 may include any number and/or combination of any current or future developed non-transitory storage devices. Non-limiting examples of such non-transitory, data storage devices 228 may include, but are not limited to one or more magnetic storage devices, one or more optical storage devices, one or more solid-state electromagnetic storage devices, one or more electroresistive storage devices, one or more molecular storage devices, one or more quantum storage devices, or various combinations thereof.

The one or more storage devices 228 may include interfaces or controllers (not shown) communicatively coupling the respective storage device(s) 228 to the one or more communications links 516, as is known by those skilled in the art. The one or more storage devices 228 may store, retain, or otherwise include a number of machine-readable instruction sets, data structures, program modules, and other data useful to the vehicular control/data acquisition system 220.

In some instances, one or more external storage devices 530 may be communicably coupled to the vehicular control/data acquisition system 220. In one example, the one or more external storage devices 530 may include one or more remote server based storage devices or "cloud" storage devices that are bidirectionally communicably coupled to the vehicular control/data acquisition system 220 via one or more wireless networks (e.g., IEEE 802.11 "Wi-Fi"), one or more wired networks (e.g., IEEE 802.3 "Ethernet"), one or more cellular networks, or combinations thereof.

A number of sensors 230 may be communicably coupled to the vehicular safety control circuitry 224 via the one or more communications links 516. In at least some implementations, such sensors 230 may autonomously collect information and/or data indicative of one or more conditions existent proximate the vehicle 202.

Machine-readable instruction sets and/or applications 538 and housekeeping instruction sets 540 may be stored or otherwise retained in whole or in part in the system memory 514. Such instruction sets may be transferred from one or more data storage devices 228 and/or one or more external storage devices 530 and stored in the system memory 514 in whole or in part for execution by at least one of the one or more configurable circuits 222.

The machine-readable instruction sets 538 may include instructions and/or logic that provide the vehicular safety control circuitry 224 with the capability to generate human perceptible output (e.g., a video display and/or an audio output) that provides the vehicle operator with information indicative of the current operating state of the traffic control device 102; the next operating state of the traffic control device 102; and the time remaining until the traffic control device 102 changes or transitions from the current operating state to the next operating state. In some implementations, the output generated by the vehicular safety control circuitry 224 may be outputted via a vehicle sound system or via a multifunction display disposed in the vehicle 202.

The machine-readable instruction sets 538 may include instructions and/or logic that provide the vehicular safety control circuitry 224 with the capability to detect and quantify one or more biometric parameters of the vehicle operator. Such biometric parameters may include data and/or information indicative of a mental alertness of the vehicle operator, a physical capacity limitation of the vehicle operator, or any other biometric parameters capable of impacting in a positive or negative manner the vehicle operator's ability to control and/or operate the vehicle 202. In at least some implementations, the machine-readable instruction sets 538 may include one or more methods of scaling the received biometric parameters to numerically evaluate and quantify the impact of the measured parameter on operational aspects of the vehicle such as: stopping distance, acceleration, collision avoidance, and similar.

The machine-readable instruction sets 538 may include instructions and/or logic that provide the vehicular safety control circuitry 224 with the capability to detect and quantify vehicle operational parameters which may include speed, acceleration/deceleration, and any other vehicle operational parameters capable of affecting the control, handling, or braking ability of the vehicle 202 as the vehicle approaches the traffic control device 102. In at least some implementations, the machine-readable instruction sets 538 may include one or more methods of scaling the received vehicle operational parameters to numerically evaluate and quantify the impact of the measured parameter on operational aspects of the vehicle such as: stopping distance, acceleration, collision avoidance, and similar.

The machine-readable instruction sets 538 may include instructions and/or logic that provide the vehicular safety control circuitry 224 with the capability to detect and quantify vehicle geolocation with respect to the known geolocation of the traffic control device 102. In at least some implementations, the machine-readable instruction sets 538 may include one or more methods of assessing the remaining time until the traffic control device 102 transitions from the current operating mode to the next operating mode and comparing the time remaining with the time required for the vehicle to traverse the distance between the current vehicle location and the traffic control device 102 as determined using the geolocation of the vehicle and the geolocation of the traffic control device 102.

The machine-readable instruction sets 538 may include instructions and/or logic that provide the vehicular safety control circuitry 224 with the capability to detect and quantify vehicular traffic and/or pedestrian traffic proximate the traffic control device 102 based, at least in part, on information and/or data provided in the message 210 broadcast by the traffic safety control circuitry 114. Such information enables the vehicular control/data acquisition system 220 to provide recommendations (e.g., accelerate/decelerate, maintain speed) based on the actual vehicular and pedestrian traffic congestion proximate the traffic control device 102.

The vehicular control/data acquisition system 220 may include one or more communicably coupled physical input devices 550, such as one or more text entry devices 552 (e.g., keyboard), one or more pointing devices 554 (e.g., mouse, trackball, touchscreen), and/or one or more audio input devices 556. Such physical input devices 550 may be used, for example, to provide, enter, or otherwise supply commands (e.g., acknowledgements, selections, confirmations, and similar) as well as information (e.g., acknowledgements, corrected subject identifiers, and similar) to the vehicular safety control circuitry 224.

The vehicular control/data acquisition system 220 may include one or more communicably coupled physical output devices 560, such as one or more visual output devices 562 (e.g., a display device), one or more tactile output devices 564 (e.g., haptic feedback or similar), one or more audio output devices 566, or combinations thereof.

For convenience, the vehicular safety control circuitry 224, the sensor interface 230, the data storage 228, the configurable circuit 222, the physical input devices 550, and the physical output devices 560 are illustrated as communicatively coupled to each other via the one or more communications links 516, thereby providing connectivity between the above-described components. In alternative embodiments, the above-described components may be communicatively coupled in a different manner than illustrated in FIG. 5. For example, one or more of the above-described components may be directly coupled to other components, or may be coupled to each other, via one or more intermediary components (not shown). In some embodiments, the one or more communications links 416 may be omitted and the components are coupled directly to each other using suitable wired or wireless connections.

Figure 6:
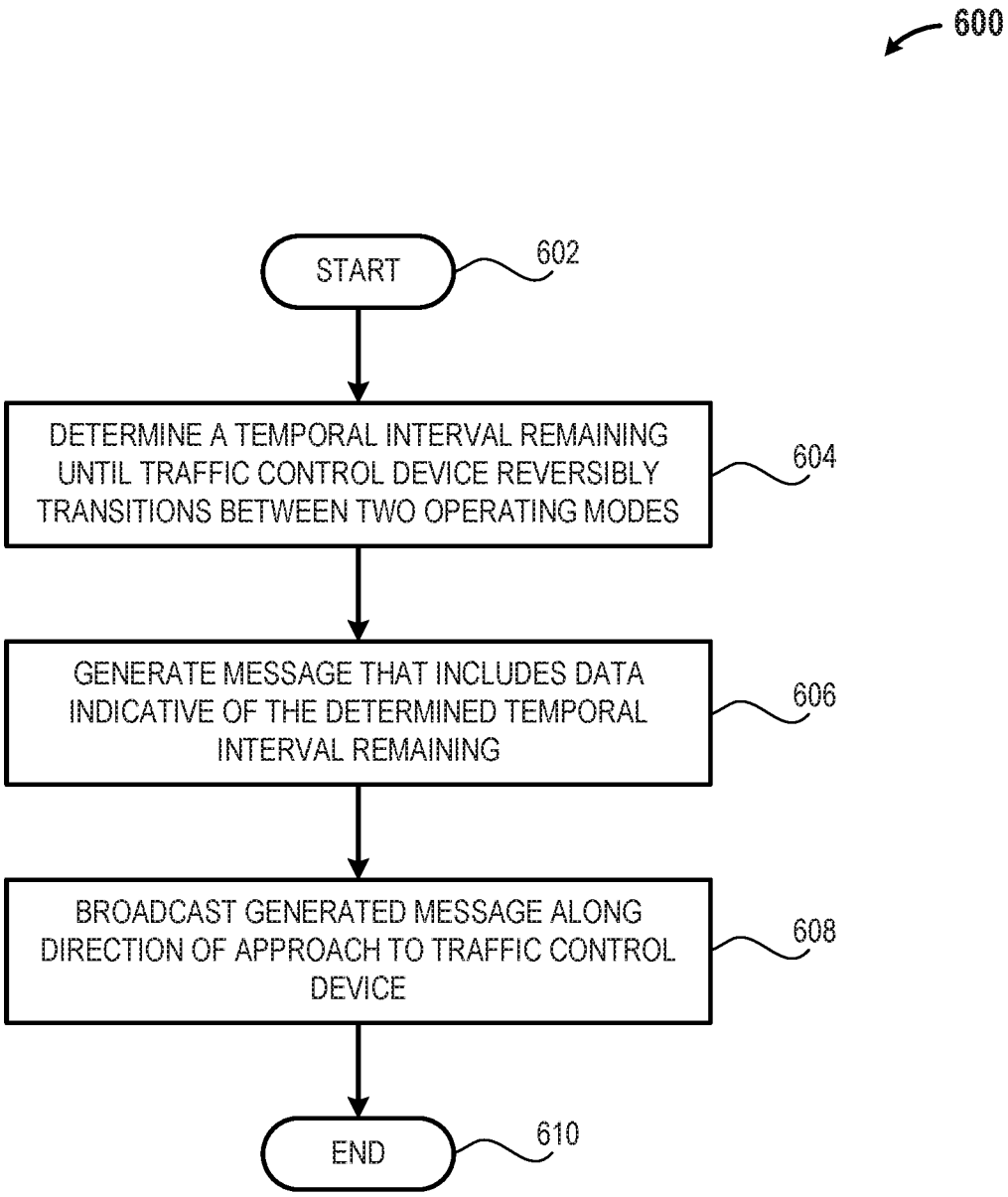
FIG. 6 is a high-level flow diagram of an illustrative traffic safety method, in accordance with at least one embodiment of the present disclosure.

FIG. 6 is a high-level flow diagram of an illustrative traffic safety method 600, in accordance with at least one embodiment of the present disclosure. A traffic control device 102 may be reversibly transitionable some or all of a plurality of operating modes. In at least some implementations, the transition of the traffic control device 102 between operating modes may be based at least in part on an elapsed time that the traffic control device 102 has been in the current operating mode. Thus, for example, a traffic control device 102 entering the current operating mode may remain in the current operating mode for a defined interval such as: 15 seconds, 30 seconds, 45 seconds, 60 seconds, 75 seconds, 120 seconds, or any other defined interval prior to transitioning to the next operating mode. Since the remaining interval until the traffic control device 102 transitions from the current operating mode to the next operating mode is known, it becomes possible to alert vehicles 202 approaching the traffic control device 102 to the upcoming operating mode transition thereby beneficially and advantageously providing the vehicle operator (or, alternatively, an autonomously operated vehicle) with the ability to respond in an appropriate manner to the upcoming transition in operating modes. The method commences at 602.

At 604, traffic safety control circuitry 114 determines a temporal interval remaining until a communicably coupled traffic control device 102 transitions from the current operating mode to the next operating mode. In some implementations, the traffic control device controller circuit 104 may communicate the remaining temporal interval between the current operating mode to the next operating mode to the traffic safety control circuitry 114 on a one time, continuous, intermittent, periodic, or aperiodic basis. For example, the traffic control device 102 may remain in each operating mode for the same amount of time (e.g., 30 seconds), based on a one time signal that includes data indicative of the current traffic control device operating mode and a one-time data transmission indicative of the interval start, the traffic safety control circuitry 114 may determine when the transition to the next operating state will occur using one or more time keeping devices (e.g., count-up or count-down timers) in the traffic safety control circuitry 114. In another example, the traffic control device controller circuit 104 may communicate the remaining temporal interval until a transition in traffic control device operating modes to the traffic safety control circuitry 114 on a periodic basis (e.g., every second).

At 606, the traffic safety control circuitry 114 generates a message 210 that includes at least information and/or data indicative of the temporal interval until the traffic control device 102 transitions from the current operating mode to the next operating mode determined at 604. In some implementations, the message 210 may include additional information. Such information may include, for example, data representative of vehicular traffic present at the traffic control device 102, data representative of pedestrian traffic present at the traffic control device 102, data representative of an estimated arrival of an emergency response vehicle at the traffic control device 102, data representative of an environmental condition proximate the traffic control device 102, or combinations thereof.

At 608, the traffic safety control circuitry 114 broadcasts the generated message 210 along at least one direction of approach to the traffic control device 102. Vehicles 202 approaching the traffic control device 102 along the direction of approach may receive the broadcast message 210. In some implementations, the traffic safety control circuitry 114 may broadcast the message 210 radially outward from the transmitter 116 such that the broadcast message 210 propagates in multiple directions and/or along multiple directions of approach to the traffic control device 102. In some implementations, the traffic safety control circuitry 114 may broadcast the message 210 using one or more directional antennas that propagate the broadcast message 210 along a defined direction of approach to the traffic control device 102. In some implementations, the traffic safety control circuitry 114 may broadcast the message 210 using limited power or other hardware/antenna configurations to limit the distance at which the broadcast message 210 may be received. Such limited distance broadcast messages may be beneficial in urban and other congested areas where multiple traffic control devices 102 may be disposed in relatively close proximity. The method 600 concludes at 610.

Figure 7:
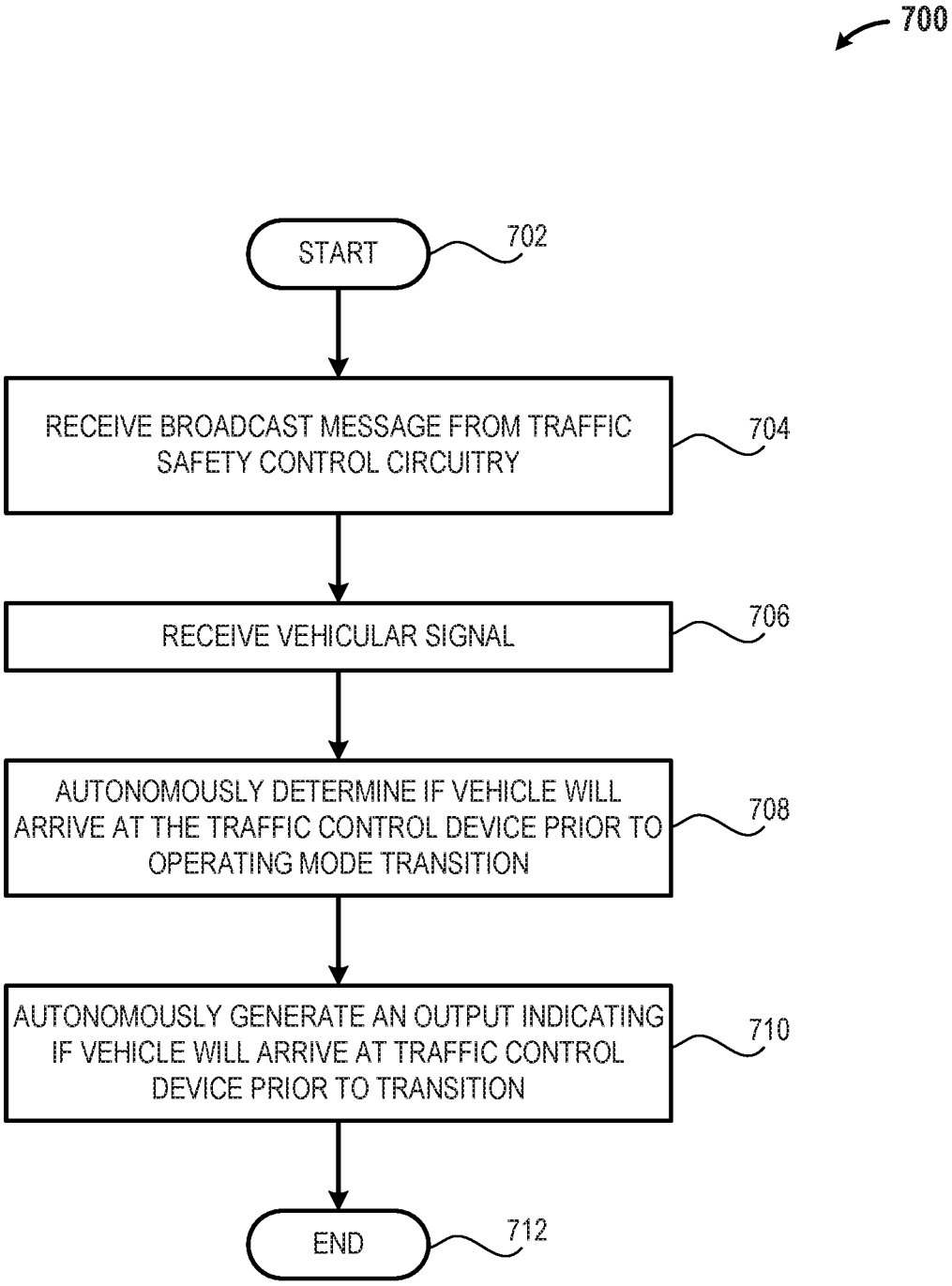
FIG. 7 is a high-level flow diagram of an illustrative vehicular safety method, in accordance with at least one embodiment of the present disclosure.

FIG. 7 is a high-level flow diagram of an illustrative vehicular safety method 700, in accordance with at least one embodiment of the present disclosure. Vehicular safety control circuitry 224 may be installed in a vehicle 202. As the vehicle 202 approaches a traffic control device 102, the receiver 226 may receive the broadcast message 210 generated and broadcast by the traffic safety control circuitry 114. The vehicular safety control circuitry 224 may use some or all of the data included in the broadcast message 210 either alone or in combination with vehicular data provided by any number of vehicular sensors 230 to autonomously determine whether the vehicle 202 will arrive at the traffic control device 102 prior to an operating mode transition of the traffic control device 102. In other implementations, the vehicular safety control circuitry 224 may provide the vehicle operator with one or more recommendations (accelerate, decelerate, maintain speed, stop, etc.) based on some or all of the information contained in the broadcast message 210 and vehicular and/or vehicle operator information collected by the vehicular safety control circuitry 224. The method 700 commences at 702.

At 704, the vehicular safety control circuitry 224 receives the broadcast message 210 from the traffic safety notification system 110. The broadcast message 210 may include data representative of the temporal interval remaining until the traffic control device 102 transitions from a current operating mode to a next operating mode. The broadcast message 210 may further include data or information indicative of the location of the traffic control device 102. The broadcast message 210 may additionally include data and/or information indicative of a number of conditions proximate the traffic control device 102. Such conditions may include, but are not limited to, vehicular traffic proximate the traffic control device 102, pedestrian traffic proximate the traffic control device 102, and/or environmental conditions proximate the traffic control device 102. In addition, the broadcast message 102 may include information and/or data indicative of an arrival of an emergency response vehicle proximate the traffic control device 102.

At 706, the vehicular safety control circuitry 224 receives one or more signals from one or more sensors 230 disposed in the vehicle 202. The one or more signals 230 may include information and/or data representative of a condition of one or more vehicular systems. The one or more signals 230 may include information and/or data representative of a speed, acceleration, or deceleration of the vehicle 202. The one or more signals 202 may include information and/or data representative of one or more parameters associated with the operator of the vehicle 202. Such vehicle operator parameters may include, but are not limited to: data and/or information indicative of a skill level associated with the vehicle operator or data and/or information indicative of one or more habits associated with the vehicle operator—both of which may be collected using historical records stored locally in the vehicle 202 or remotely stored records.

At 708, the vehicular safety control circuitry 224 may determine whether the vehicle 202 will arrive at the traffic control device 102 prior to the traffic control device 102 transitioning from the current operating mode to the next operating mode. In some implementations, the vehicular safety control circuitry 224 may make such a determination based on some or all of the information and/or data included in the broadcast signal 210. In some implementations, the vehicular safety control circuitry 224 may make such a determination based on some or all of the information and/or data included in the vehicular signals provided by the sensor(s) 230. In some implementations, the vehicular safety control circuitry 224 may make such a determination based on some or all of the information and/or data included in the broadcast signal 210 and based on some or all of the information and/or data included in the vehicular signals provided by the sensor(s) 230.

In at least some implementations, the vehicular safety control circuitry 224 may assign weighting factors to some or all of the information included in the broadcast signal 210 and/or the signals provided by the vehicular sensors 230. The weighting factors may be applied to various parameters and the parameters combined to determine a scoring value. In some implementations, the scoring value may be indicative of whether the vehicle will arrive at the traffic control device 102 prior to the traffic control device 102 transitioning from the current operating mode to the next operating mode. In other implementations, the scoring value may be indicative of whether the vehicle should accelerate, decelerate, or maintain speed.

At 710, the vehicular safety control circuitry 224 autonomously generates an output indicative of whether the vehicle 202 will reach the traffic control device 102 prior to the traffic control device 102 transitioning from the current operating mode to the next operating mode. In some implementations, the output may include an audio output, a visual output, or an audio/visual output. In embodiments, the vehicular safety control circuitry 224 may autonomously generate an output indicative of whether the vehicle should accelerate, decelerate, or maintain speed based on the interval remaining until the traffic control device 102 transitions from the current operating mode to the next operating mode. The method 700 concludes at 712.

Additionally, operations for the embodiments have been further described with reference to the above figures and accompanying examples. Some of the figures may include a logic flow. Although such figures presented herein may include a particular logic flow, it can be appreciated that the logic flow merely provides an example of how the general functionality described herein can be implemented. Further, the given logic flow does not necessarily have to be executed in the order presented unless otherwise indicated. In addition, the given logic flow may be implemented by a hardware element, a software element executed by a processor, or any combination thereof. The embodiments are not limited to this context.

Various features, aspects, and embodiments have been described herein. The features, aspects, and embodiments are susceptible to combination with one another as well as to variation and modification, as will be understood by those having skill in the art. The present disclosure should, therefore, be considered to encompass such combinations, variations, and modifications. Thus, the breadth and scope of the present invention should not be limited by any of the above-described exemplary embodiments, but should be defined only in accordance with the following claims and their equivalents.

As used in any embodiment herein, the term "module" may refer to software, firmware and/or circuitry configured to perform any of the aforementioned operations. Software may be embodied as a software package, code, instructions, instruction sets and/or data recorded on non-transitory computer readable storage medium. Firmware may be embodied as code, instructions or instruction sets and/or data that are hard-coded (e.g., nonvolatile) in memory devices. "Circuitry", as used in any embodiment herein, may comprise, for example, singly or in any combination, hardwired circuitry, programmable circuitry such as computer processors comprising one or more individual instruction processing cores, state machine circuitry, and/or firmware that stores instructions executed by programmable circuitry. The modules may, collectively or individually, be embodied as circuitry that forms part of a larger system, for example, an integrated circuit (IC), system on-chip (SoC), desktop computers, laptop computers, tablet computers, servers, smart phones, etc.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents. Various features, aspects, and embodiments have been described herein. The features, aspects, and embodiments are susceptible to combination with one another as well as to variation and modification, as will be understood by those having skill in the art. The present disclosure should, therefore, be considered to encompass such combinations, variations, and modifications.

Reference throughout this specification to "one embodiment" or "an embodiment" means that a particular feature, structure, or characteristic described in connection with the embodiment is included in at least one embodiment. Thus, appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

The following examples pertain to further embodiments. The following examples of the present disclosure may comprise subject material such as a device, a method, means for performing acts based on the method and/or a system for improving the performance of an application launch on a mobile device. Such systems and methods advantageously and beneficially facilitate an improved user experience as well as reducing overall power consumption of the mobile device.

According to example 1, there is provided an intelligent infrastructure system. The system may include a traffic control device transitionable between at least a first operating mode and a second operating mode and a traffic safety notification system operably coupled to the traffic control device. The traffic safety notification system may include transmitter circuitry; controller circuitry communicably coupled to the transmitter circuitry; at least one storage device communicably coupled to the controller circuitry and including machine-readable instructions, that when executed by the controller circuitry, transform the controller circuitry to traffic safety control circuitry, the traffic safety control circuitry to: determine a temporal interval remaining until a transition between traffic control device operating modes is to occur; and broadcast at least one message that includes data representative of the determined temporal interval.

Example 2 may include elements of example 1, and the system may additionally include at least one sensor to detect at least one environmental condition proximate the traffic control device, wherein the at least one broadcast message further includes data indicative of the detected environmental condition proximate the traffic control device.

Example 3 may include elements of example 1, and the system may further include at least one receiver to receive emergency response transmissions, wherein the at least one broadcast message further includes data indicative of an arrival of an emergency response vehicle proximate the traffic control device.

Example 4 may include elements of example 1, and the system may further include at least one sensor to detect a presence of at least one of: vehicular traffic or pedestrian traffic proximate the traffic control device, wherein the at least one broadcast message may further include data indicative of the presence of the vehicular traffic or the pedestrian traffic proximate the traffic control device.

Example 5 may include elements of example 1 where the transmitter circuitry may include at least one directional antenna to focused in a direction of approach of vehicular traffic to the traffic control device.

Example 6 may include elements of example 1 where the traffic control device may include a vehicular traffic signaling device, the first operating mode includes a visible signal indicating approaching traffic should proceed through the vehicular traffic signaling device, and the second operating mode may include a visible signal indicating the approaching traffic should stop at the vehicular traffic signaling device.

Example 7 may include elements of example 1 where the traffic control device may include a railroad crossing signaling device, the first operating mode includes a visible signal indicating approaching traffic should proceed through the railroad crossing signaling device, and the second operating mode may include a visible signal indicating the approaching traffic should stop at the railroad crossing signaling device.

Example 8 may include elements of example 1 where the traffic control device may include a travel hazard signaling device, the first operating mode includes a visible signal indicating an existence of a potential hazard along a direction of approach to the caution signaling device, and the second operating mode may include a signal indicating an absence of potential hazards along the direction of approach to the caution signaling device.

According to example 9, there is provided a traffic safety device. The traffic safety device may include transmitter circuitry; antenna circuitry communicably coupled to the transmitter circuitry; controller circuitry communicably coupled to the transmitter circuit, the controller circuitry including at least one interface communicably coupleable to a traffic control device transitionable among each of a plurality of operating modes; and at least one storage device communicably coupled to the controller circuitry and including machine-readable instructions, that when executed by the controller circuitry, transform the controller circuitry to traffic safety control circuitry, the traffic safety control circuitry to: determine a temporal interval remaining until a mode transition of the traffic control device between at least two of the plurality of operating modes; and broadcast at least one message that includes data representative of the determined temporal interval and data indicative of a geolocation of the traffic control device.

Example 10 may include elements of example 9, and the device may additionally include at least one sensor communicably coupled to the controller circuitry, the at least one sensor to detect at least one environmental condition proximate the traffic control device, wherein the at least one broadcast message may further include data indicative of the detected environmental condition proximate the traffic control device.

Example 11 may include elements of example 9, and the device may additionally include at least one receiver communicably coupled to the controller circuitry, the at least one receiver to receive a transmission from an emergency response vehicle, wherein the at least one broadcast message may further include data indicative of the arrival of the emergency response vehicle proximate the traffic control device.

Example 12 may include elements of example 9, and the device may further include at least one proximity sensor communicably coupled to the controller circuitry, the at least one proximity sensor to detect a presence of at least one of: vehicular traffic or pedestrian traffic proximate the traffic control device, wherein the at least one broadcast message may further include data indicative of the detected presence of the vehicular traffic or the pedestrian traffic proximate the traffic control device.

Example 13 may include elements of example 9, and the device may further include at least one roadway traffic sensor communicably coupled to the controller circuitry, the at least one roadway traffic sensor to detect a presence of vehicular traffic proximate the traffic control device, wherein the at least one broadcast message may further include data indicative of the detected presence of the vehicular traffic proximate the traffic control device.

Example 14 may include elements of example 10, and the device may further include a traffic control signal operating mode detection circuit communicably coupled to the controller circuitry, the traffic control signal operating mode detection circuit to provide an indication to the traffic safety control circuitry of a change in traffic control device operating mode; wherein, if a change in traffic control device operating mode is not detected at the expiration of the temporal interval, the traffic safety control circuitry may generate a broadcast message that may further include data representative of a remaining temporal interval value equal to zero (0).

Example 15 may include elements of example 9 where the antenna circuitry may include at least one directional antenna to focused in a direction of approach of vehicular traffic to the traffic control device.

According to example 16, there is provided a vehicular safety control system. The system may include receiver circuitry; a display device; antenna circuitry communicably coupled to the receiver circuitry; controller circuitry communicably coupled to the receiver circuitry and to the display device; and at least one storage device communicably coupled to the controller circuitry and including machine-readable instructions, that when executed by the controller circuitry, transform the controller circuitry to provide specialized vehicular safety control circuitry, the vehicular safety control circuitry to: receive a broadcast message from traffic safety control circuitry operably coupled to a traffic control device, the message including data representative of a temporal interval remaining until a traffic control device operating mode transitions between at least two of a plurality of operating modes; receive at least one vehicular signal that includes data representative of at least a current vehicular speed and a current distance between the vehicle and the traffic control device; autonomously determine whether the vehicle will arrive at the traffic control device prior to the transition in operating modes based at least on the temporal interval remaining until the transition in traffic control device operating modes, the vehicular speed and the distance between the vehicle and the traffic control device; and autonomously generate a display output on the display device indicative of whether the vehicle will arrive at the traffic control device prior to the transition in traffic control device operating modes.

Example 17 may include elements of example 16 where the broadcast message may further include data indicative of a time of arrival of an emergency response vehicle proximate the traffic control device; and wherein the vehicular safety control circuitry may autonomously recommend one or more vehicle operator actions based on the remaining temporal interval until the traffic control device operating mode transition and the time of arrival at the traffic control device of the emergency response vehicle.

Example 18 may include elements of example 16, where the broadcast message may further include data indicative of an environmental condition proximate the traffic control device; and where the vehicular safety control circuitry may autonomously recommend one or more vehicle operator actions based on the remaining temporal interval until the traffic control device operating mode transition and the environmental conditions proximate the traffic control device.

Example 19 may include elements of example 16, where the broadcast message may further include data indicative of at least one of: vehicular traffic or pedestrian traffic proximate the traffic control device; and where the vehicular safety control circuitry may autonomously recommend one or more vehicle operator actions based on the remaining temporal interval until the traffic control device operating mode transition and the presence of the vehicular traffic or the pedestrian traffic proximate the traffic control device.

Example 20 may include elements of example 16, where the at least one vehicular signal may further include data indicative of a vehicle operator parameter that includes at least one of: a driving habit of the vehicle operator or a skill level of the vehicle operator; and where the vehicular safety control circuitry may autonomously recommend one or more vehicle operator actions based on the remaining temporal interval until the traffic control device operating mode transition and the vehicle operator parameter.

According to example 21, there is provided a traffic safety method. The method may include determining, by traffic safety control circuitry, a temporal interval remaining until an operating mode transition of a communicably coupled traffic control device from a current operating mode to a next operating mode; generating, by the traffic safety control circuitry, a message that includes data indicative of the determined temporal interval remaining until the communicably coupled traffic control device transitions from the current operating mode to the next operating mode; and broadcasting, by the traffic safety control circuitry, the generated message along at least one direction of approach to the traffic control device.

Example 22 may include elements of example 21 where broadcasting the generated message may include broadcasting, by the traffic safety control circuitry, a range limited signal that includes the generated message.

Example 23 may include elements of example 21 where broadcasting the generated message may include broadcasting, by the traffic safety control circuitry, a, range-limited, directional signal that includes the generated message; wherein the traffic safety control circuitry broadcasts the directional signal in a direction of vehicular traffic approaching the traffic control device.

Example 24 may include elements of example 21, and the method may additionally include receiving, by the traffic safety control circuitry, a signal that includes data indicative of a presence or an absence of vehicular traffic proximate the traffic control device, where generating a message that includes data indicative of the determined temporal interval remaining until the communicably coupled traffic control device transitions from the current operating mode to the next operating mode may include generating, by the traffic safety control circuitry, a signal that includes: data indicative of a temporal interval equal to zero ("0") responsive to the determined temporal interval reaching a value of zero ("0"); and the data indicative of an absence of vehicular traffic proximate the traffic control device.

Example 25 may include elements of example 21, and the method may additionally include receiving, by the traffic safety control circuitry, a signal that includes data indicative of at least one environmental condition proximate the traffic control device; where generating a message that includes data indicative of the determined temporal interval remaining until the communicably coupled traffic control device transitions from the current operating mode to the next operating mode may include generating, by the traffic safety control circuitry, a signal that may include the data indicative of the determined temporal interval; and the received data indicative of the at least one environmental condition proximate the traffic control device.

Example 26 may include elements of example 21, and the method may additionally include receiving, by the traffic safety control circuitry, a signal that includes data indicative of an arrival of an emergency response vehicle proximate the traffic control device; where generating a message that includes data indicative of the determined temporal interval remaining until the communicably coupled traffic control device transitions from the current operating mode to the next operating mode may include generating, by the traffic safety control circuitry, a signal that may include the data indicative of the determined temporal interval; and the received data indicative of the arrival of the emergency response vehicle proximate the traffic control device.

Example 27 may include elements of example 21, and the method may additionally include: receiving, by the traffic safety control circuitry, a signal that includes data indicative of a presence of at least one of: vehicular traffic or pedestrian traffic proximate the traffic control device; where generating a message that includes data indicative of the determined temporal interval remaining until the communicably coupled traffic control device transitions from the current operating mode to the next operating mode may include generating, by the traffic safety control circuitry, a signal that may include the data indicative of the determined temporal interval; and the received data indicative of a presence of at least one of: vehicular traffic or pedestrian traffic proximate the traffic control device.

According to example 28, there is provided a traffic safety system. The system may include: a means for determining a temporal interval remaining until a communicably coupled traffic control device transitions between a current operating mode and a next operating mode; a means for generating a message that includes data indicative of the determined temporal interval remaining until the communicably coupled traffic control device transitions from the current operating mode to the next operating mode; and a means for broadcasting the generated message.

Example 29 may include elements of example 28 where the means for broadcasting the generated message may include broadcasting a range limited signal that includes the generated message.

Example 30 may include elements of example 28 where the means for broadcasting the generated message may include broadcasting a range-limited, directional signal that includes the generated message; wherein the traffic safety control circuitry broadcasts the directional signal in a direction of vehicular traffic approaching the traffic control device.

Example 31 may include elements of example 28, and the system may additionally include a means for receiving a signal that includes data indicative of a presence or an absence of vehicular traffic proximate the traffic control device; where the means for generating a message that includes data indicative of the determined temporal interval remaining until the communicably coupled traffic control device transitions from the current operating mode to the next operating mode may include a means for generating a signal that may include data indicative of a temporal interval equal to zero ("0") responsive to the determined temporal interval reaching a value of zero ("0"); and the received data indicative of an absence of vehicular traffic proximate the traffic control device.

Example 32 may include elements of example 28, and the system may additionally include a means for receiving a signal that includes data indicative of at least one environmental condition proximate the traffic control device; where the means for generating a message that includes data indicative of the determined temporal interval remaining until the communicably coupled traffic control device transitions from the current operating mode to the next operating mode may include a means for generating a signal that may include the data indicative of the determined temporal interval; and the received data indicative of the at least one environmental condition proximate the traffic control device.

Example 33 may include elements of example 28, and the system may additionally include a means for receiving a signal that includes data indicative of an arrival of an emergency response vehicle proximate the traffic control device; where the means for generating a message that includes data indicative of the determined temporal interval remaining until the communicably coupled traffic control device transitions from the current operating mode to the next operating mode may include a means for generating a signal that may include the data indicative of the determined temporal interval; and the received data indicative of the arrival of the emergency response vehicle proximate the traffic control device.

Example 34 may include elements of example 28, and the system may additionally include a means for receiving a signal that includes data indicative of a presence of at least one of: vehicular traffic or pedestrian traffic proximate the traffic control device; where the means for generating a message that includes data indicative of the determined temporal interval remaining until the communicably coupled traffic control device transitions from the current operating mode to the next operating mode may include a means for generating a signal that may include the data indicative of the determined temporal interval; and the received data indicative of a presence of at least one of: vehicular traffic or pedestrian traffic proximate the traffic control device.

According to example 35, there is provided a vehicular traffic safety method. The method may include receiving, by the vehicular safety control circuitry, a broadcast message from traffic safety control circuitry operably coupled to a traffic control device, the broadcast message including data representative of a temporal interval remaining until a traffic control device operating mode transitions between at least two of a plurality of operating modes; receiving, by the vehicular safety control circuitry, at least one vehicular signal that includes data representative of at least a current vehicular speed and a current distance between the vehicle and the traffic control device; autonomously determining, by the vehicular safety control circuitry, whether the vehicle will arrive at the traffic control device prior to the transition in operating modes based at least on the temporal interval remaining until the transition in traffic control device operating modes, the vehicular speed, and the distance between the vehicle and the traffic control device; and autonomously generating, by the vehicular safety control circuitry, a display output on the display device indicative of whether the vehicle will arrive at the traffic control device prior to the transition in traffic control device operating modes.

Example 36 may include elements of example 35, and the method may additionally include autonomously recommending, by the vehicular safety control circuitry, one or more vehicle operator actions based on the remaining temporal interval until the traffic control device operating mode transition and a time of arrival at the traffic control device of an emergency response vehicle; where receiving a broadcast message from traffic safety control circuitry operably coupled to a traffic control device may further include: receiving a broadcast message from the traffic safety control circuitry that further includes data indicative of the time of arrival of the emergency response vehicle at the traffic control device.

Example 37 may include elements of example 35, and the method may additionally include autonomously recommending, by the vehicular safety control circuitry, one or more vehicle operator actions based on the remaining temporal interval until the traffic control device operating mode transition and an environmental condition proximate the traffic control device; where receiving a broadcast message from traffic safety control circuitry operably coupled to a traffic control device may further include: receiving a broadcast message from the traffic safety control circuitry that further includes data indicative of the environmental condition proximate the traffic control device.

Example 38 may include elements of example 35, and the method may additionally include autonomously recommending, by the vehicular safety control circuitry, one or more vehicle operator actions based on the remaining temporal interval until the traffic control device operating mode transition and a presence of vehicular traffic or pedestrian traffic proximate the traffic control device; where receiving a broadcast message from traffic safety control circuitry operably coupled to a traffic control device may further include: receiving a broadcast message from the traffic safety control circuitry that further includes data indicative of at least one of: the vehicular traffic proximate the traffic control device or the pedestrian traffic proximate the traffic control device.

Example 39 may include elements of example 35, and the method may additionally include autonomously recommending, by the vehicular safety control circuitry, one or more vehicle operator actions based on the remaining temporal interval until the traffic control device operating mode transition and a vehicle operator performance parameter; where receiving at least one vehicular signal may further include: receiving at least one vehicular signal that includes data representative of the current vehicular speed and the current distance between the vehicle and the traffic control device and the data indicative of the vehicle operator performance parameter that includes at least one of: a driving habit of the vehicle operator or a skill level of the vehicle operator.

Example 40 may include elements of example 35, and the method may additionally include autonomously recommending, by the vehicular safety control circuitry, one or more vehicle operator actions based on the remaining temporal interval until the traffic control device operating mode transition and a vehicle operator biometric parameter; where receiving at least one vehicular signal may further include: receiving at least one vehicular signal that includes data representative of the current vehicular speed and the current distance between the vehicle and the traffic control device and the data indicative of the vehicle operator biometric parameter.

According to example 41, there is provided a traffic safety system. The system may include a means for determining a temporal interval remaining until an operating mode transition of a communicably coupled traffic control device from a current operating mode to a next operating mode; a means for generating a message that includes data indicative of the determined temporal interval remaining until the communicably coupled traffic control device transitions from the current operating mode to the next operating mode; and a means for broadcasting the generated message to at least one vehicle approaching the traffic control device.

Example 42 may include elements of example 41 where the means for broadcasting the generated message may include a means for broadcasting, by the traffic safety control circuitry, a range limited signal that includes the generated message to the at least one vehicle approaching the traffic control device.

Example 43 may include elements of example 41 where broadcasting the generated message may include a means for broadcasting a range-limited, directional signal that includes the generated message to the at least one vehicle approaching the traffic control device.

Example 44 may include elements of example 41, and the system may additionally include a means for receiving a signal that includes data indicative of a presence or an absence of vehicular traffic proximate the traffic control device; where the means for generating a message that includes data indicative of the determined temporal interval remaining until the communicably coupled traffic control device transitions from the current operating mode to the next operating mode may include a means for generating, by the traffic safety control circuitry, a message that may include: data indicative of a temporal interval equal to zero ("0") responsive to the determined temporal interval reaching a value of zero ("0"); and the data indicative of an absence of vehicular traffic proximate the traffic control device.

Example 45 may include elements of example 41, and the system may additionally include a means for receiving a signal that includes data indicative of at least one environmental condition proximate the traffic control device; where the means for generating a message that includes data indicative of the determined temporal interval remaining until the communicably coupled traffic control device transitions from the current operating mode to the next operating mode may include a means for generating a message that may include the data indicative of the determined temporal interval; and the received data indicative of the at least one environmental condition proximate the traffic control device.

Example 46 may include elements of example 41, and the system may additionally include a means for receiving a signal that includes data indicative of an arrival of an emergency response vehicle proximate the traffic control device; where the means for generating a message that includes data indicative of the determined temporal interval remaining until the communicably coupled traffic control device transitions from the current operating mode to the next operating mode may include a means for generating a message that may include the data indicative of the determined temporal interval; and the received data indicative of the arrival of the emergency response vehicle proximate the traffic control device.

Example 47 may include elements of example 41, and the system may additionally include a means for receiving a signal that includes data indicative of a presence of at least one of: vehicular traffic or pedestrian traffic proximate the traffic control device; where the means for generating a message that includes data indicative of the determined temporal interval remaining until the communicably coupled traffic control device transitions from the current operating mode to the next operating mode may include a means for generating a message that may include the data indicative of the determined temporal interval; and the received data indicative of a presence of at least one of: vehicular traffic or pedestrian traffic proximate the traffic control device.

According to example 48, there is provided a vehicular traffic safety system. The system may include a means for receiving a broadcast message from traffic safety control circuitry operably coupled to a traffic control device, the broadcast message including data representative of a temporal interval remaining until a traffic control device operating mode transitions between at least two of a plurality of operating modes; a means for receiving at least one vehicular signal that includes data representative of at least a current vehicular speed and a current distance between the vehicle and the traffic control device; a means for autonomously determining whether the vehicle will arrive at the traffic control device prior to the transition in operating modes based at least on the temporal interval remaining until the transition in traffic control device operating modes, the vehicular speed, and the distance between the vehicle and the traffic control device; and a means for autonomously generating a display output on the display device indicative of whether the vehicle will arrive at the traffic control device prior to the transition in traffic control device operating modes.

Example 48 may include elements of example 48, and the system may additionally include a means for autonomously recommending one or more vehicle operator actions based on the remaining temporal interval until the traffic control device operating mode transition and a time of arrival at the traffic control device of an emergency response vehicle; where the means for receiving a broadcast message from traffic safety control circuitry operably coupled to a traffic control device may further include a means for receiving a broadcast message from the traffic safety control circuitry that further includes data indicative of the time of arrival of the emergency response vehicle at the traffic control device.

Example 49 may include elements of example 48, and the system may additionally include a means for autonomously recommending one or more vehicle operator actions based on the remaining temporal interval until the traffic control device operating mode transition and an environmental condition proximate the traffic control device; where the means for receiving a broadcast message from traffic safety control circuitry operably coupled to a traffic control device may further include a means for receiving a broadcast message from the traffic safety control circuitry that further includes data indicative of the environmental condition proximate the traffic control device.

Example 50 may include elements of example 48, and the system may additionally include a means for autonomously recommending one or more vehicle operator actions based on the remaining temporal interval until the traffic control device operating mode transition and a presence of vehicular traffic or pedestrian traffic proximate the traffic control device; where the means for receiving a broadcast message from traffic safety control circuitry operably coupled to a traffic control device may further include: a means for receiving a broadcast message from the traffic safety control circuitry that further includes data indicative of at least one of: the vehicular traffic proximate the traffic control device or the pedestrian traffic proximate the traffic control device.

Example 51 may include elements of example 48, and the system may additionally include a means for autonomously recommending one or more vehicle operator actions based on the remaining temporal interval until the traffic control device operating mode transition and a vehicle operator performance parameter; where the means for receiving at least one vehicular signal may further include: a means for receiving at least one vehicular signal that includes data representative of the current vehicular speed and the current distance between the vehicle and the traffic control device and the data indicative of the vehicle operator performance parameter that may further include at least one of: a driving habit of the vehicle operator or a skill level of the vehicle operator.

Example 52 may include elements of example 48, and the system may additionally include a means for autonomously recommending one or more vehicle operator actions based on the remaining temporal interval until the traffic control device operating mode transition and a vehicle operator biometric parameter; where the means for receiving at least one vehicular signal may further include: a means for receiving at least one vehicular signal that includes data representative of the current vehicular speed and the current distance between the vehicle and the traffic control device and the data indicative of the vehicle operator biometric parameter.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents.

What is claimed:

1. An intelligent infrastructure system, comprising:

a traffic control device transitionable between at least a first operating mode and a second operating mode;

a traffic safety notification system operably coupled to the traffic control device, the traffic safety notification system including:

transmitter circuitry;

controller circuitry communicably coupled to the transmitter circuitry;

at least one storage device communicably coupled to the controller circuitry and including machine-readable instructions, that when executed by the controller circuitry, transform the controller circuitry to traffic safety control circuitry, the traffic safety control circuitry to:

determine a temporal interval remaining until a transition between traffic control device operating modes is to occur;

receive, from vehicular safety control circuitry carried by a vehicle, a vehicular signal that includes data representative of at least a current speed of the vehicle and a vehicle operator parameter that includes at least one of: a driving habit of the vehicle operator or a skill level of the vehicle operator; and autonomously determine one or more recommended vehicle operator actions based on the remaining temporal interval until the traffic control device operating mode transition and the vehicle speed and vehicle operator parameter included in the vehicular signal;

autonomously determine whether the vehicle will arrive at the traffic control device prior to the transition in operating modes based at least on the temporal interval remaining until the transition in traffic control device operating modes, the vehicular speed and the distance between the vehicle; and autonomously generate an output signal, the output signal to cause an output on an output device disposed in the vehicle, the output including information indicative of whether the vehicle will arrive at the traffic control device prior to the transition in traffic control device operating modes and information indicative of the one or more recommended vehicle operator actions.

2. The system of claim 1, further comprising:

at least one sensor to detect at least one environmental condition proximate the traffic control device;

wherein the output signal further includes data indicative of the detected environmental condition proximate the traffic control device; and wherein the one or more recommended vehicle operator actions are based, at least in part, on the detected environmental condition proximate the traffic control device.

3. The system of claim 1, further comprising:

at least one receiver to receive emergency response transmissions;

wherein the output signal further includes data indicative of an arrival of an emergency response vehicle proximate the traffic control device; and wherein the one or more recommended vehicle operator actions are based, at least in part, on the received emergency response transmissions.

4. The system of claim 1, further comprising:

at least one sensor to detect a presence of at least one of: vehicular traffic or pedestrian traffic proximate the traffic control device;

wherein the output signal further includes data indicative of the presence of the vehicular traffic or the pedestrian traffic proximate the traffic control device; and wherein the one or more recommended vehicle operator actions are based, at least in part, on the detected presence of at least one of: the vehicular traffic or the pedestrian traffic proximate the traffic control device.

5. The system of claim 1 wherein the transmitter circuitry comprises at least one directional antenna to focus in a direction of approach of vehicular traffic to the traffic control device.

6. The system of claim 1 wherein the traffic control device comprises a vehicular traffic signaling device, the first operating mode includes a visible signal indicating approaching traffic should proceed through the vehicular traffic signaling device, and the second operating mode includes a visible signal indicating the approaching traffic should stop at the vehicular traffic signaling device.

7. The system of claim 1 wherein the traffic control device comprises a railroad crossing signaling device, the first operating mode includes a visible signal indicating approaching traffic should proceed through the railroad crossing signaling device, and the second operating mode includes a visible signal indicating the approaching traffic should stop at the railroad crossing signaling device.

8. The system of claim 1 wherein the traffic control device comprises a travel hazard signaling device, the first operating mode includes a visible signal indicating an existence of a potential hazard along a direction of approach to the caution signaling device, and the second operating mode includes a signal indicating an absence of potential hazards along the direction of approach to the caution signaling device.

9. A traffic safety device, comprising:

transmitter circuitry;

antenna circuitry communicably coupled to the transmitter circuitry;

controller circuitry communicably coupled to the transmitter circuit, the controller circuitry including at least one interface communicably coupleable to a traffic control device transitionable among each of a plurality of operating modes; and at least one storage device communicably coupled to the controller circuitry and including machine-readable instructions, that when executed by the controller circuitry, transform the controller circuitry to traffic safety control circuitry, the traffic safety control circuitry to:

determine a temporal interval remaining until a mode transition of the traffic control device between at least two of the plurality of operating modes;

receive, from vehicular safety control circuitry carried by a vehicle, a vehicular signal that includes data representative of at least a current speed of the vehicle and a vehicle operator parameter that includes at least one of: a driving habit of the vehicle operator or a skill level of the vehicle operator; and autonomously determine one or more recommended vehicle operator actions based on the remaining temporal interval until the traffic control device operating mode transition and the vehicle speed and vehicle operator parameter included in the vehicular signal;

autonomously determine whether the vehicle will arrive at the traffic control device prior to the transition in operating modes based at least on the temporal interval remaining until the transition in traffic control device operating modes, the vehicular speed and the distance between the vehicle; and autonomously generate an output signal, the output signal to cause an output on an output device disposed in the vehicle, the output including information indicative of whether the vehicle will arrive at the traffic control device prior to the transition in traffic control device operating modes and information indicative of the one or more recommended vehicle operator actions.

10. The traffic safety device of claim 9, further comprising:

at least one sensor communicably coupled to the controller circuitry, the at least one sensor to detect at least one environmental condition proximate the traffic control device;

wherein the output signal further includes data indicative of the detected environmental condition proximate the traffic control device; and wherein the one or more recommended vehicle operator actions are based, at least in part, on the detected environmental condition proximate the traffic control device.

11. The traffic safety device of claim 9, further comprising:

at least one receiver communicably coupled to the controller circuitry, the at least one receiver to receive a transmission from an emergency response vehicle;

wherein the output signal further includes data indicative of the arrival of the emergency response vehicle proximate the traffic control device; and wherein the one or more recommended vehicle operator actions are based, at least in part, on the data indicative of the arrival of the emergency response vehicle proximate the traffic control device.

12. The traffic safety device of claim 9, further comprising:

at least one proximity sensor communicably coupled to the controller circuitry, the at least one proximity sensor to detect a presence of at least one of: vehicular traffic or pedestrian traffic proximate the traffic control device;

wherein the output signal further includes data indicative of the detected presence of the vehicular traffic or the pedestrian traffic proximate the traffic control device; and wherein the one or more recommended vehicle operator actions are based, at least in part, on the data indicative of the detected presence of the vehicular traffic or the pedestrian traffic proximate the traffic control device.

13. The traffic safety device of claim 9, further comprising:

at least one roadway traffic sensor communicably coupled to the controller circuitry, the at least one roadway traffic sensor to detect a presence of vehicular traffic proximate the traffic control device;

wherein the output signal further includes data indicative of the detected presence of the vehicular traffic proximate the traffic control device; and wherein the one or more recommended vehicle operator actions are based, at least in part, on the data indicative of the detected presence of the vehicular traffic proximate the traffic control device.

14. The traffic safety device of claim 9, further comprising:

a traffic control signal operating mode detection circuit communicably coupled to the controller circuitry, the traffic control signal operating mode detection circuit to provide an indication to the traffic safety control circuitry of a change in traffic control device operating mode;

wherein, if a change in traffic control device operating mode is not detected at the expiration of the temporal interval, the output signal further includes data representative of a remaining temporal interval value equal to zero (0).

15. The traffic safety device of claim 9 wherein the antenna circuitry comprises at least one directional antenna to focused in a direction of approach of vehicular traffic to the traffic control device.

16. A vehicular safety control system, comprising:

receiver circuitry;

a display device;

antenna circuitry communicably coupled to the receiver circuitry;

controller circuitry communicably coupled to the receiver circuitry and to the display device; and at least one storage device communicably coupled to the controller circuitry and including machine-readable instructions, that when executed by the controller circuitry, transform the controller circuitry to provide specialized vehicular safety control circuitry, the vehicular safety control circuitry to:

autonomously communicate a vehicular signal that includes data representative of at least a current speed of the vehicle and a vehicle operator parameter that includes at least one of: a driving habit of the vehicle operator or a skill level of the vehicle operator to traffic safety control circuitry disposed proximate a traffic control device;

receive at least one output signal from the traffic safety control circuitry, the output signal including:

information indicative of one or more recommended vehicle operator actions based on the remaining temporal interval until the traffic control device operating mode transitions between at least two of a plurality of operating modes, data representative of the at least one roadway condition proximate the traffic control device, and the vehicle speed and the vehicle operator parameter included in the vehicular signal; and information indicative of whether the vehicle will arrive at the traffic control device prior to the transition in traffic control device operating modes.

17. The vehicular safety control system of claim 16:

wherein the output signal further includes data indicative of a time of arrival of an emergency response vehicle proximate the traffic control device; and wherein the information indicative of one or more recommended vehicle operator actions is based on the remaining temporal interval until the traffic control device operating mode transition and the time of arrival at the traffic control device of the emergency response vehicle.

18. The vehicular safety control system of claim 16:

wherein the output signal further includes data indicative of an environmental condition proximate the traffic control device; and wherein the information indicative of one or more recommended vehicle operator actions is based on the remaining temporal interval until the traffic control device operating mode transition and the environmental conditions proximate the traffic control device.

19. The vehicular safety control system of claim 16:

wherein the broadcast message further comprises data indicative of at least one of: vehicular traffic or pedestrian traffic proximate the traffic control device; and wherein the information indicative of one or more recommended vehicle operator actions is based on the remaining temporal interval until the traffic control device operating mode transition and the presence of the vehicular traffic or the pedestrian traffic proximate the traffic control device.

20. The vehicular safety control system of claim 16:

wherein the at least one vehicular signal further includes data indicative of a vehicle operator parameter that includes at least one of: a driving habit of the vehicle operator or a skill level of the vehicle operator; and wherein the information indicative of one or more recommended vehicle operator actions is based on the remaining temporal interval until the traffic control device operating mode transition and the vehicle operator parameter.

21. A traffic safety method, comprising:

determining, by traffic safety control circuitry, a temporal interval remaining until an operating mode transition of a communicably coupled traffic control device from a current operating mode to a next operating mode;

receiving from one or more sensors, by the traffic safety control circuitry, a signal that includes data representative of at least one roadway condition proximate the traffic control device;

receiving, by the traffic safety control circuitry, at least one vehicular signal that includes data representative of at least a current vehicular speed and a current distance between the vehicle and the traffic control device;

wherein the at least one vehicular signal further includes data indicative of a vehicle operator parameter that includes at least one of: a driving habit of the vehicle operator or a skill level of the vehicle operator; and wherein the vehicular safety control circuitry autonomously recommends one or more vehicle operator actions based on the remaining temporal interval until the traffic control device operating mode transition, at least one roadway condition proximate the traffic control device, and the vehicle operator parameter;

autonomously determining, by the traffic safety control circuitry, whether the vehicle will arrive at the traffic control device prior to the transition in operating modes based at least on the temporal interval remaining until the transition in traffic control device operating modes, the vehicular speed and the distance between the vehicle, the at least one roadway condition proximate the traffic control device, and the traffic control device; and autonomously generating, by the traffic safety control circuitry, an output signal, the output signal to cause an output on an output device disposed in the vehicle, the output including information indicative of whether the vehicle will arrive at the traffic control device prior to the transition in traffic control device operating modes and information indicative of the one or more recommended vehicle operator actions.

22. The traffic safety method of claim 21 wherein autonomously generating the output signal further comprises:

autonomously generating the output signal, by the traffic safety control circuitry, a range limited output signal.

23. The traffic safety method of claim 21 wherein autonomously generating the output signal further comprises:

broadcasting, by the traffic safety control circuitry, a, range-limited, directional signal that includes the generated message; wherein the traffic safety control circuitry broadcasts the directional signal in a direction of vehicular traffic approaching the traffic control device.

24. The traffic safety method of claim 21, further comprising:

receiving, by the traffic safety control circuitry, a signal that includes data indicative of a presence or an absence of vehicular traffic proximate the traffic control device;

wherein the output signal further includes data indicative of a temporal interval equal to zero ("0") responsive to the determined temporal interval reaching a value of zero ("0"); and the data indicative of an absence of vehicular traffic proximate the traffic control device.

25. The traffic safety method of claim 21, further comprising:

receiving, by the traffic safety control circuitry, a signal that includes data indicative of at least one environmental condition proximate the traffic control device;

wherein the output signal further includes the data indicative of the determined temporal interval; and the received data indicative of the at least one environmental condition proximate the traffic control device.

26. The traffic safety method of claim 21, further comprising:

receiving, by the traffic safety control circuitry, a signal that includes data indicative of an arrival of an emergency response vehicle proximate the traffic control device;

wherein the output signal further includes the data indicative of the determined temporal interval; and the received data indicative of the arrival of the emergency response vehicle proximate the traffic control device.

27. The traffic safety method of claim 21, further comprising:

receiving, by the traffic safety control circuitry, a signal that includes data indicative of a presence of at least one of: vehicular traffic or pedestrian traffic proximate the traffic control device;

wherein the output signal further includes the data indicative of the determined temporal interval; and the received data indicative of a presence of at least one of: vehicular traffic or pedestrian traffic proximate the traffic control device.

* * * * *